US006318256B1

(12) United States Patent
Hirai

(10) Patent No.: US 6,318,256 B1
(45) Date of Patent: Nov. 20, 2001

(54) PRINTING APPARATUS

(75) Inventor: Keisuke Hirai, Kyoto (JP)

(73) Assignee: Dainippon Screen Mfg Co., Ltd., Kyoto (JP)

( * ) Notice: Subject to any disclaimer, the term of this patent is extended or adjusted under 35 U.S.C. 154(b) by 0 days.

(21) Appl. No.: 09/156,905

(22) Filed: Sep. 18, 1998

(30) Foreign Application Priority Data

Oct. 9, 1997 (JP) ..... 9-293603

(51) Int. Cl.[7] ..... B41F 5/16; B41F 5/18; B41F 13/24; B41N 1/00

(52) U.S. Cl. ..... 101/177; 101/183; 101/233; 101/395

(58) Field of Search ..... 101/136, 137, 101/141, 142, 151–153, 172, 174, 177, 181, 183–185, 211, 216, 232, 246, 247, 490, 233, 395, 401.1

(56) References Cited

U.S. PATENT DOCUMENTS 2,911,907 11/1959 Davidson .
4,448,125 5/1984 Kawaguchi et al. .
5,469,787 11/1995 Turner et al. .

FOREIGN PATENT DOCUMENTS 3-143634 6/1991 (JP) .

*Primary Examiner*—Kimberly L. Asher
(74) *Attorney, Agent, or Firm*—Arent Fox Kintner Plotkin & Kahn, PLLC

(57) ABSTRACT

A printing apparatus includes a first plate cylinder and a second plate cylinder. Each plate cylinder supports a plate mounted peripherally thereof having two image areas. Four ink feeders contact and feed inks to the image areas on the plate when mounted on the first and second plate cylinders. A first blanket cylinder has a diameter equal to a diameter of the first plate cylinder and is contactable therewith. A second blanket cylinder has a diameter equal to a diameter of the second plate cylinder and is contactable therewith. An impression cylinder having a diameter half the diameter of either the first and second plate cylinders as well as the first and second blanket cylinders, is contactable with the first and second blanket cylinders. A pair of grippers that each hold an end of the printing paper maintain two sheets of printing paper peripherally of the impression cylinder. A paper feed cylinder feeds the printing paper to the impression cylinder. A paper discharge cylinder discharges the printing paper from the impression cylinder after a required printing process. A gripper control mechanism controls the grippers to selectively carry out either one of a first opening and closing operation once for every rotation of the impression cylinder and a second opening and closing operation once for every two rotations of the impression cylinder.

12 Claims, 30 Drawing Sheets

PRINTING APPARATUS

BACKGROUND OF THE INVENTION

1. Field of the Invention

The present invention relates to a printing apparatus for feeding ink to plates mounted peripherally of a plate cylinder, and transferring the ink through a blanket cylinder to printing paper wrapped around an impression cylinder.

2. Description of the Related Art

A known printing apparatus of the type noted above includes a plate cylinder for supporting a plurality of plates mounted peripherally thereof, a plurality of ink feeders for feeding different color inks to image areas on the plurality of plates mounted on the plate cylinder, respectively, and a single impression cylinder. Such a printing apparatus is capable of color printing by using the single plate cylinder and the single impression cylinder. Thus, the entire apparatus requires a reduced area for its installation and operation.

Japanese Patent Publication (Unexamined) H3-143634 (1991), for example, describes a printing apparatus for printing images on printing paper with two color inks. This apparatus includes a plate cylinder for supporting two plates mounted peripherally thereof, two ink feeders for feeding the different inks to the respective plates on the plate cylinder, a single dampening water feeder for feeding dampening water to each plate on the plate cylinder, and an impression cylinder having half a diameter of the plate cylinder. A sheet of printing paper is fed for every two rotations of the impression cylinder.

However, the printing apparatus described in the above patent publication always prints with two color inks, and is incapable of monochromatic printing.

SUMMARY OF THE INVENTION

An object of the present invention, therefore, is to provide a printing apparatus with a plate cylinder for supporting a plate mounted peripherally thereof, the plate having two image areas, for allowing images to be printed selectively with a single color ink and with two color inks.

The above object is fulfilled, according to the present invention, by a printing apparatus comprises a plate cylinder for supporting a plate as mounted peripherally thereof, the plate having two image areas, two ink feeders for contacting and feeding inks to the image areas on the plate mounted on the plate cylinder; a blanket cylinder equal in diameter to and contactable with the plate cylinder; an impression cylinder having a diameter n/2 (n being an odd number) of the diameter of the plate cylinder and the blanket cylinder, and contactable with the blanket cylinder; n printing paper holder(s) (each) having a gripper for holding an end of the printing paper to maintain n sheet(s) of the printing paper peripherally of the impression cylinder; a printing paper feeder for feeding the printing paper to the impression cylinder; a printing paper discharger for discharging the printing paper from the impression cylinder after a required printing process; and a printing paper holder control mechanism for controlling the printing paper holders to carry out selectively a first opening and closing operation once for every rotation of the impression cylinder, and a second opening and closing operation once for every two rotations of the impression cylinder.

In a preferred embodiment of the invention, the printing paper holder control mechanism comprises a fixed cam disposed laterally of the impression cylinder, the fixed cam being contactable with a cam follower attached to the gripper of the printing paper holder, to open the gripper, thereby opening and closing the printing paper holder once for every rotation of the impression cylinder; a movable cam disposed coaxially with the fixed cam, the movable cam being movable between an open/close prohibiting position for prohibiting the printing paper holder from opening and closing by action of the fixed cam, and an open/close permitting position for permitting the printing paper holder to open and close by action of the fixed cam; a movable cam drive mechanism for reciprocating the movable cam between the open/close prohibiting position and the open/close permitting position with rotation of the impression cylinder; and a movable cam stop mechanism for stopping the movable cam in the open/close permitting position regardless of the rotation of the impression cylinder.

Preferably, the movable cam drive mechanism comprises a cam rotatable synchronously with the blanket cylinder; and a link mechanism coupled to the movable cam, the link mechanism including a cam follower contactable with the cam rotating synchronously with the blanket cylinder, to be pivotable with the rotation of the blanket cylinder to reciprocate the movable cam between the open/close prohibiting position and the open/close permitting position.

The movable cam stop mechanism may comprise a stopper for prohibiting pivotal movement of the link mechanism.

In another aspect of the invention, a printing apparatus comprises a first and a second plate cylinders each for supporting a plate as mounted peripherally thereof, the plate having two image areas, two ink feeders for contacting and feeding inks to the image areas on the plate mounted on the first plate cylinder; two ink feeders for contacting and feeding inks to the image areas on the plate mounted on the second plate cylinder; a first blanket cylinder equal in diameter to and contactable with the first plate cylinder; a second blanket cylinder equal in diameter to and contactable with the second plate cylinder; an impression cylinder having a diameter n/2 (n being an odd number) of the diameter of the first and second plate cylinders and the first and second blanket cylinders, and contactable with the first and second blanket cylinders; n printing paper holder(s) (each) having a gripper for holding an end of the printing paper to maintain n sheet(s) of the printing paper peripherally of the impression cylinder; a printing paper feeder for feeding the printing paper to the impression cylinder; a printing paper discharger for discharging the printing paper from the impression cylinder after a required printing process; and a printing paper holder control mechanism for controlling the printing paper holders to carry out selectively a first opening and closing operation once for every rotation of the impression cylinder, and a second opening and closing operation once for every two rotations of the impression cylinder.

The printing apparatus according to the present invention provides a first and a second plate cylinders each for supporting a plate as mounted peripherally thereof, the plate having two image areas. This construction allows a selection between printing with one or two color inks and printing with four color inks.

In a further aspect of the invention, a printing apparatus comprises a plate cylinder for supporting a plate as mounted peripherally thereof, the plate having two image areas; two ink feeders for selectively contacting and feeding inks to the image areas on the plate mounted on the plate cylinder; a blanket cylinder equal in diameter to and contactable with the plate cylinder; an impression cylinder having n/2 (n being an odd number) of the diameter of the plate cylinder and the blanket cylinder, and contactable with the blanket cylinder; n gripper(s) each for holding an end of the printing paper on the impression cylinder; a printing paper feeder and discharger for feeding the printing paper to the impression cylinder and discharging the printing paper from the impression cylinder; and a control mechanism for controlling the gripper(s) and the printing paper feeder and discharger to carry out selectively a first operation once for every rotation of the impression cylinder when both images of the two image areas on the plate are the same image, and a second operation once for every two rotations of the impression cylinder when both images of the images areas on the plate are different images.

Other features and advantages of the present invention will be apparent from the following detailed description of the embodiments of the invention.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Embodiments of the present invention will be described hereinafter with reference to the drawings.

Figure 1:
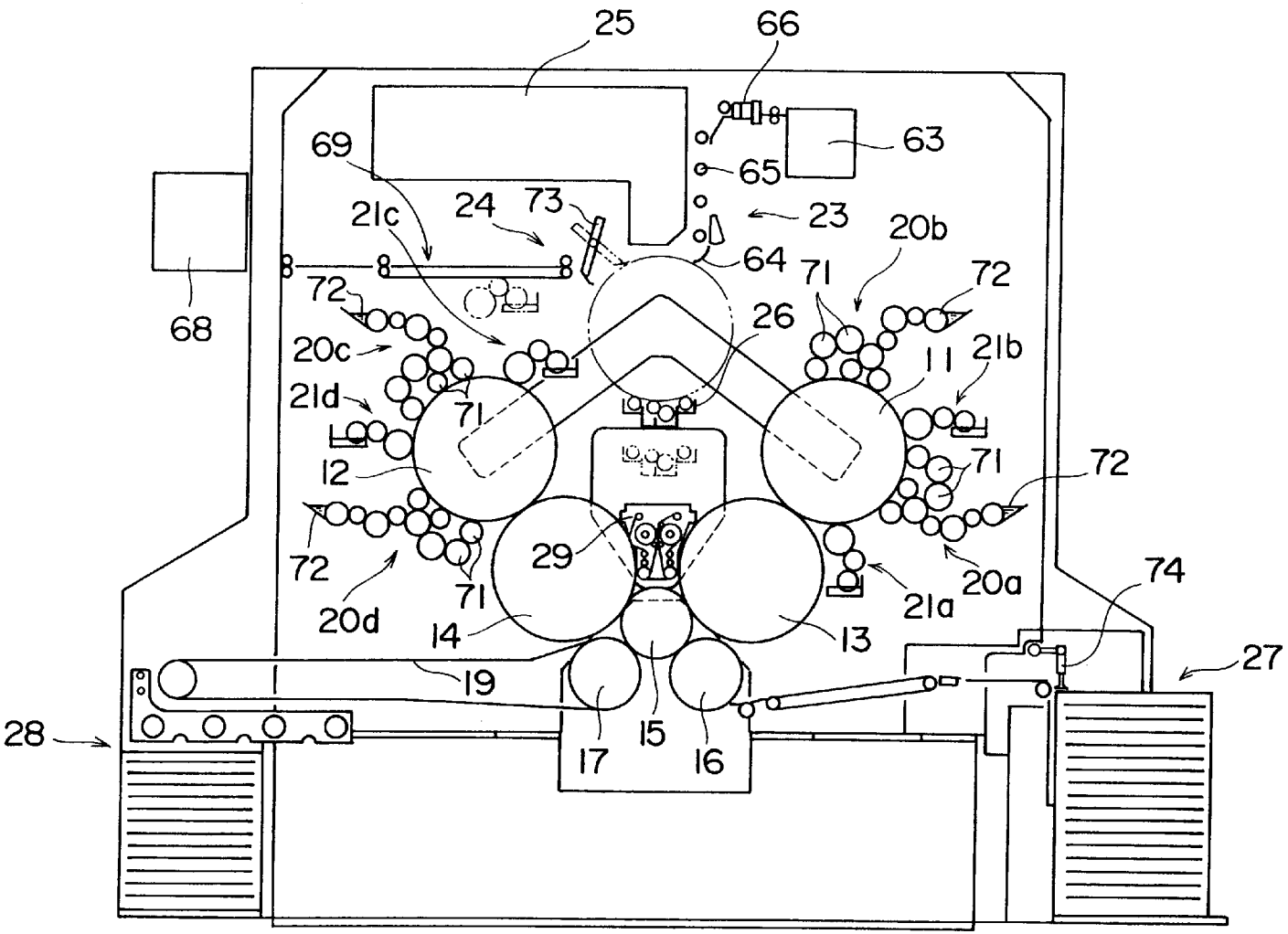
FIG. 1 is a schematic side view of a printing apparatus according to the present invention.

The construction and operation of a printing apparatus embodying the invention will be described first. FIG. 1 is a schematic side view of the printing apparatus according to the present invention.

This printing apparatus records images on blank plates mounted on first and second plate cylinders 11 and 12, feeds inks to the plates having the images recorded thereon, and transfers the inks from the plates through first and second blanket cylinders 13 and 14 to printing paper held on an impression cylinder 15, thereby printing the images on the printing paper.

The first plate cylinder 11 is movable between a first printing position shown in a solid line and an image recording position shown in a two-dot chain line in FIG. 1. The second plate cylinder 12 is movable between a second printing position shown in a solid line in FIG. 1 and the same image recording position.

Around the first plate cylinder 11 in the first printing position are an ink feeder 20*a* for feeding an ink of black (K), for example, to the plate, an ink feeder 20*b* for feeding an ink of magenta (M), for example, to the plate, and dampening water feeders 21*a* and 21*b* for feeding dampening water to the plate. Around the second plate cylinder 12 in the second printing position are an ink feeder 20*c* for feeding an ink of cyan (C), for example, to the plate, an ink feeder 20*d* for feeding an ink of yellow (Y), for example, to the plate, and dampening water feeders 21*c* and 21*d* for feeding dampening water to the plate. Further, around the first or second plate cylinder 11 or 12 in the image recording position are a plate feeder 23, a plate remover 24, an image recorder 25 and a developing device 26.

The first blanket cylinder 13 is contactable with the first plate cylinder 11, while the second blanket cylinder 14 is contactable with the second plate cylinder 12. The impression cylinder 15 is contactable with the first and second blanket cylinders 13 and 14 in different positions. The apparatus further includes a paper feed cylinder 16 for transferring printing paper supplied from a paper storage 27 to the impression cylinder 15, a paper discharge cylinder 17 with chains 19 wound thereon for discharging printed paper from the impression cylinder 15 to a paper discharge station 28, and a blanket cleaning unit 29.

Each of the first and second plate cylinders 11 and 12 is coupled to a plate cylinder moving mechanism not shown, and driven by this moving mechanism to reciprocate between the first or second printing position and the image recording position. In the first printing position, the first plate cylinder 11 is rotatable synchronously with the first blanket cylinder 13. In the second printing position, the second plate cylinder 12 is rotatable synchronously with the second blanket cylinder 14. Adjacent the image recording position is a plate cylinder rotating mechanism, not shown, for rotating the first or second plate cylinder 11 or 12 whichever is in the image recording position.

The plate feeder 23 and plate remover 24 are arranged around the first or second plate cylinder 11 or 12 in the image recording position.

The plate feeder 23 includes a supply cassette 63 storing a roll of elongate blank plate in light-shielded state, a guide member 64 and guide rollers 65 for guiding a forward end of the plate drawn from the cassette 63 to the surface of the first or second plate cylinder 11 or 12, and a cutter 66 for cutting the elongate plate into sheet plates. Each of the first and second plate cylinders 11 and 12 has a pair of grippers, not shown, for gripping the forward and rear ends of the plate fed from the plate feeder 23.

The plate remover 24 has a pawl mechanism 73 for separating a plate from the first or second plate cylinder 11 or 12 after a printing operation, and a conveyor mechanism 69 for transporting the plate separated by the pawl mechanism 73 to a discharge cassette 68.

The forward end of the plate drawn from the feeder cassette 63 is guided by the guide rollers 65 and guide member 64, and gripped by one of the grippers on the first or second plate cylinder 11 or 12. Then, the first or second plate cylinder 11 or 12 is rotated by the plate cylinder rotating mechanism not shown, whereby the plate is wrapped around the first or second plate cylinder 11 or 12. The rear end of the plate cut by the cutter 66 is gripped by the other gripper. While, in this state, the first or second plate cylinder 11 or 12 is rotated at low speed, the image recorder 25 irradiates the surface of the plate mounted peripherally of the first or second plate cylinder 11 or 12 with a modulated laser beam for recording images thereon.

Figure 2A:
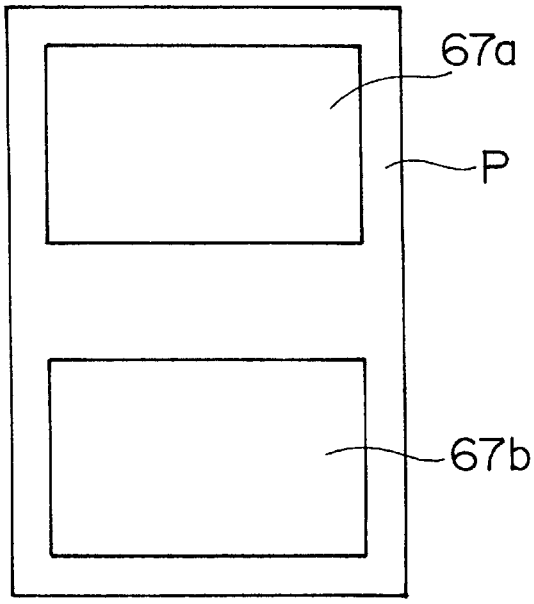
FIGS. 2A and 2B are explanatory views each showing an arrangement of image areas on a plate.
Figure 2B:
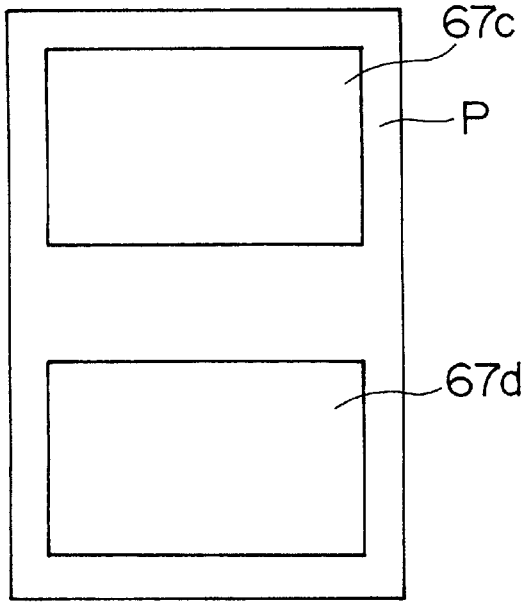

On the plate P mounted peripherally of the first plate cylinder 11, the image recorder 25, records an image area 67*a* to be printed with black ink, and an image area 67*b* to be printed with magenta ink, as shown in FIG. 2A. On the plate P mounted peripherally of the second plate cylinder 12, the image recorder 25 records an image area 67*c* to be printed with cyan ink, and an image area 67*d* to be printed with yellow ink, as shown in FIG. 2B. The image areas 67*a* and 67*b* are recorded in evenly separated positions, i.e. in positions separated from each other by 180 degrees, on the plate P mounted peripherally of the first plate cylinder 11. Similarly, the image areas 67*c* and 67*d* are recorded in evenly separated positions, i.e. in positions separated from each other by 180 degrees, on the plate P mounted peripherally of the second plate cylinder 12.

When this apparatus is used in monochromatic or two-color printing, as described hereinafter, an image is formed in the image areas 67*a* and 67*b* or image areas 67*c* and 67*d* to be printed with the same ink.

Figure 3:
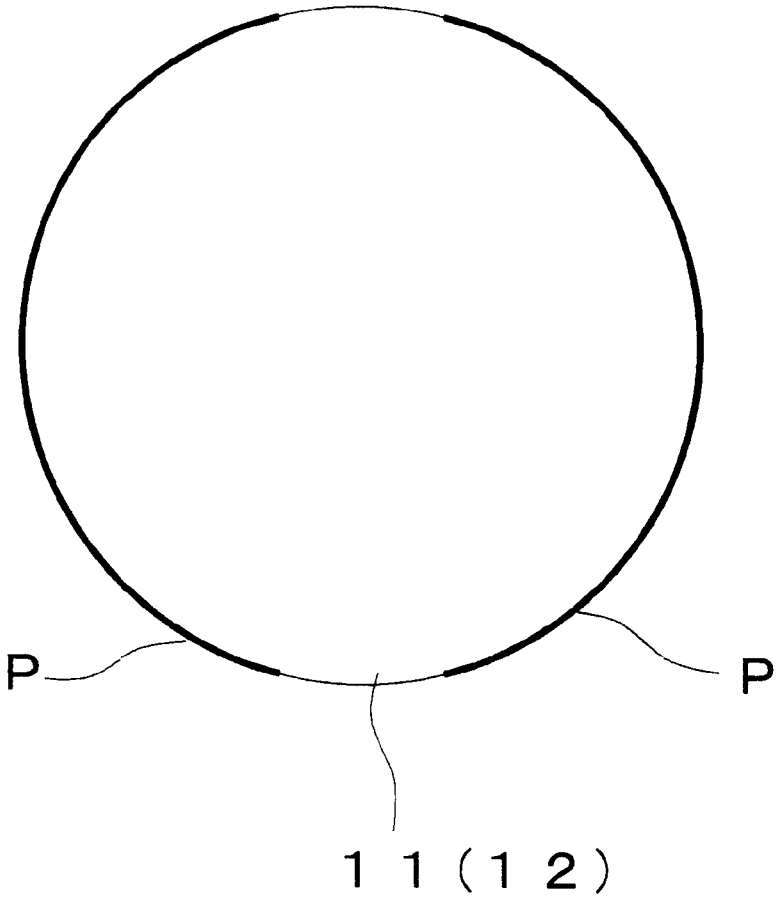
FIG. 3 is a schematic view showing two plates, each having a single image area, mounted peripherally of a plate cylinder.

In the foregoing embodiment, two image areas 67*a* and 67*b* or 67*c* and 67*d* are provided on the single plate P mounted peripherally of the first or second plate cylinder 11 or 12, in order to simplify the structure of the first or second plate cylinder 11 or 12. Alternatively, the first or second plate cylinder 11 or 12 may include two sets of grippers, each set for holding the forward and rear ends of one plate P. Then, as shown in FIG. 3, each of the first and second plate cylinders 11 and 12 may support two plates P each having a single image area. As used herein, the term "holding a plate having two image areas" should be interpreted to include the case of holding a single plate having two image areas and the case of holding two plates each having a single image area. In the latter case also, the two plates P should be held as evenly separated on the first or second plate cylinder 11 or 12, so that the image areas recorded on the respective plates are in evenly separated positions, i.e. in positions separated from each other by 180 degrees.

Referring again to FIG. 1, the ink feeders 20*a* and 20*b* are arranged around the first plate cylinder 11 in the first printing position, while the ink feeders 20*c* and 20*d* are arranged around the second plate cylinder 12 in the second printing position, as described hereinbefore. Each of these ink feeders 20*a*, 20*b*, 20*c* and 20*d* (which may be referred to collectively as "ink feeders 20") includes a plurality of ink rollers 71 and an inkwell 72.

The ink rollers 71 of the ink feeders 20*a* and 20*b* are swingable by action of cams or the like not shown. With the swinging movement, the ink rollers 71 of the ink feeder 20*a* or 20*b* come into contact with one of the two image areas 67*a* and 67*b* formed on the plate P mounted peripherally of the first plate cylinder 11. Thus, the ink is fed only to an intended one of the image areas 67*a* and 67*b*. Similarly, the ink rollers 71 of the ink feeders 20*c* and 20*d* are swingable by action of cams or the like not shown. With the swinging movement, the ink rollers 71 of the ink feeder 20*c* or 20*d* come into contact with one of the two image areas 67*c* and 67*d* formed on the plate P mounted peripherally of the second plate cylinder 12. Thus, the ink is fed only to an intended one of the image areas 67*c* and 67*d*.

The dampening water feeders 21*a*, 21*b*, 21*c* and 21*d* (which may be referred to collectively as "dampening water feeders 21") feed dampening water to the plates P before the ink feeders 20 feed the inks thereto. Of these dampening water feeders 21, the water feeder 21*a* feeds dampening water to the image area 67*a* on the plate P, the water feeder 21*b* feeds dampening water to the image area 67*b* on the plate P, the water feeder 21*c* feeds dampening water to the image area 67*c* on the plate P, and the water feeder 21*d* feeds dampening water to the image area 67*d* on the plate P.

The developing device 26 is disposed under the first or second plate cylinder 11 or 12 in the image recording position. This developing device 26 includes a developing unit, a fixing unit and a squeezing unit, which are vertically movable between a standby position shown in two-dot chain lines and a developing position shown in solid lines in FIG. 1.

In developing the images recorded on the plate P by the image recorder 25, the developing unit, fixing unit and squeezing unit are successively brought into contact with the plate P rotated with the first or second plate cylinder 11 or 12.

The first and second blanket cylinders 13 and 14 movable into contact with the first and second plate cylinders 11 and 12 have the same diameter as the first and second plate cylinders 11 and 12, and have ink transfer blankets mounted peripherally thereof. Each of the first and second blanket cylinders 13 and 14 is movable into and out of contact with the first or second plate cylinder 11 or 12 and the impression cylinder 15 by a contact mechanism described hereinafter.

The first and second blanket cylinders 13 and 14 with the soft blankets mounted peripherally thereof are slightly reduced in diameter when in contact with the first and second plate cylinders 11 and 12. As used herein, the term "the same diameter" allows for slight errors due to such changes in diameter. Further, as described hereinafter, the impression cylinder 15, paper feed cylinder 16 and paper discharge cylinder 17 have half the diameter of the first and second plate cylinders 11 and 12 and the first and second blanket cylinders 13 and 14. This also allows for slight errors due to changes in diameter.

Figure 4:
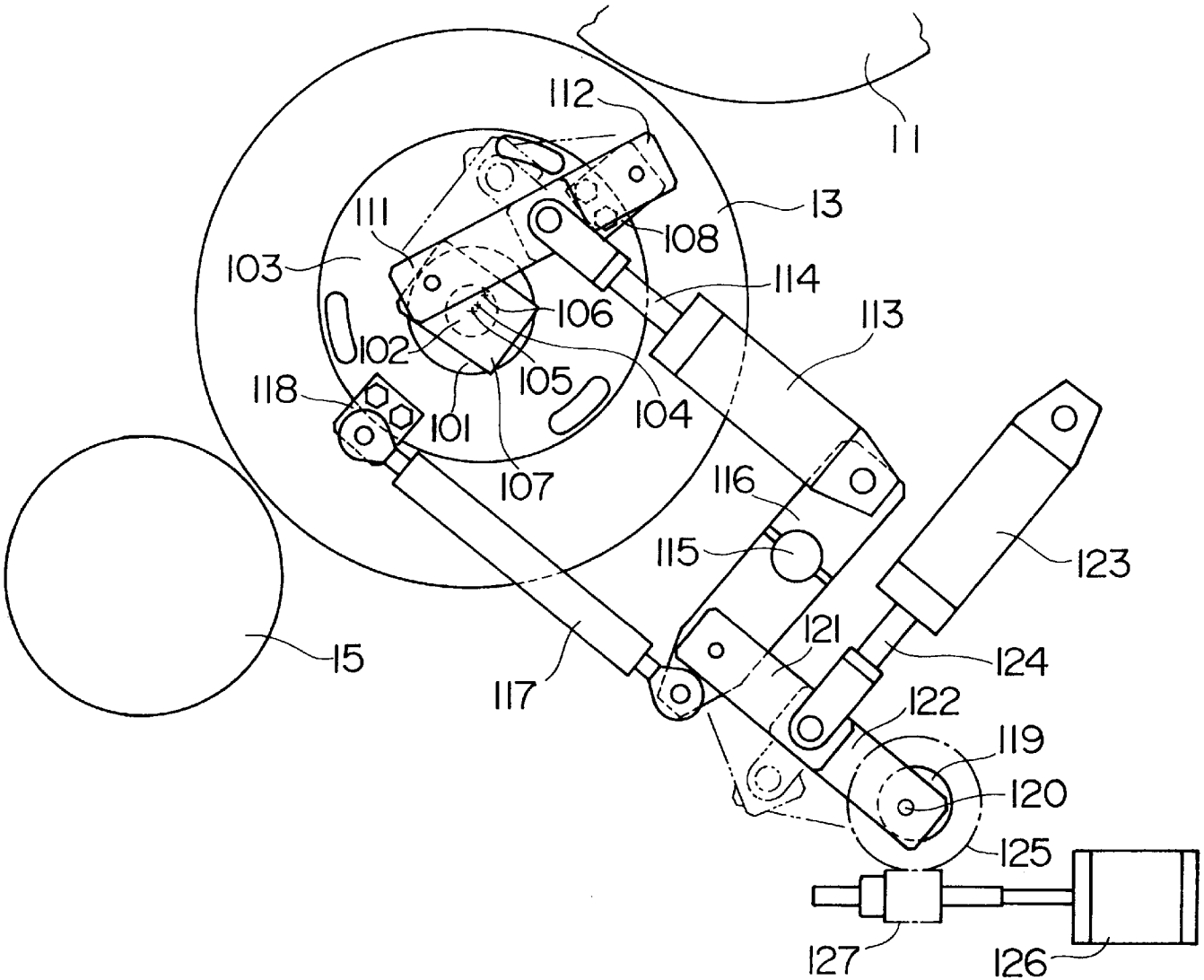
FIG. 4 is a schematic view of a contact mechanism for acting on a first blanket cylinder.

FIG. 4 is a schematic view of the contact mechanism for acting on the first blanket cylinder 13. The contact mechanism for the second blanket cylinder 14 is similar in structure to the contact mechanism shown in FIG. 4.

The first blanket cylinder 13 is rotatably supported by a shaft 101. An eccentric shaft 102 decentered from the shaft 101 is formed on a side thereof. The eccentric shaft 102 is surrounded by an eccentric bearing 103 decentered from the shafts 101 and 102. Thus, as shown in FIG. 4, the axis 104 of the shaft 101, i.e. the axis of the first blanket cylinder 13, the axis 105 of the eccentric shaft 102 and the axis 106 of the eccentric bearing 103 are offset from one another.

The eccentric shaft 102 has a plate 107 fixed thereto, while the eccentric bearing 103 has a plate 108 fixed thereto. The two fixed plates 107 and 108 are interconnected by two coupling plates 111 and 112 forming a link mechanism. The forward end of a cylinder rod 114 of an air cylinder 113 is connected to a connection between the two coupling plates 111 and 112. The air cylinder 113 has a cylinder body coupled to an end of a rotary plate 116 rotatable about a shaft 115. The other end of the rotary plate 116 is coupled through a rod 117 to a plate 118 fixed to the eccentric bearing 103.

The rotary plate 116 is coupled to a shaft 120 of an eccentric member 119 through two coupling plates 121 and 122 forming a link mechanism. The forward end of a cylinder rod 124 of an air cylinder 123 fixed to a main body of the apparatus is connected to a connection between the two coupling plates 121 and 122. The eccentric member 119 has a worm wheel 125 connected thereto and meshed with a worm gear 127 rotatable by a motor 126.

With the cylinder rods 114 and 124 of the air cylinders 113 and 123 extended as shown in FIG. 4, the surface of the first blanket cylinder 13 is spaced slightly from the surfaces of the first plate cylinder 11 and the impression cylinder 15.

When the air cylinder 113 is driven to retract the cylinder rod 114, the first blanket cylinder 13 is moved toward and into contact with the first plate cylinder 11 by action of the link mechanism formed of the two coupling plates 111 and 112.

When the air cylinder 123 is driven to retract the cylinder rod 124, the first blanket cylinder 13 is moved toward and into contact with the impression cylinder 15 by action of the link mechanism formed of the two coupling plates 121 and 122. At this time, the rotary plate 116 also rotates clockwise about the shaft 115, whereby the first blanket cylinder 13 moves not only toward the impression cylinder 15 but also toward the first plate cylinder 11. Consequently, the first blanket cylinder 13 is maintained in contact with the first plate cylinder 11.

Rotation of the eccentric member 119 results in a slight movement of its shaft 120. Thus, the contact pressure of the first blanket cylinder 13 for contacting the impression cylinder 15 and the first plate cylinder 11 may be adjusted by driving the motor 126 to rotate the worm wheel 125 connected to the eccentric member 119 thereby to move the shaft 120 slightly. This enables adjustment of a printing pressure in time of printing with the first blanket cylinder 13.

Referring again to FIG. 1, the blanket cleaning unit 29 disposed between the first and second blanket cylinders 13 and 14 cleans the surfaces of the first and second blanket cylinders 13 and 14 by feeding a cleaning solution to an elongate cleaning cloth extending from a delivery roll to a take-up roll through a plurality of pressure rollers, and sliding the cleaning cloth in contact with the first and second blanket cylinders 13 and 14. The cleaning cloth may further be brought into contact with the surface of the impression cylinder 15 for cleaning the same.

The impression cylinder 15 contactable by the first and second blanket cylinders 13 and 14 has half the diameter of the first and second plate cylinders 11 and 12 and the first and second blanket cylinders 13 and 14, as noted hereinbefore. Further, the impression cylinder 15 has a gripper 573, which will be described later in regards to FIGS. 17 and 21–32 for holding and transporting the forward end of printing paper.

The paper feed cylinder 16 disposed adjacent the impression cylinder 15 has the same diameter as the impression cylinder 15. The paper feed cylinder 16 has a gripper 574, which will also be described later in regards to FIGS. 17 and 21–32, for holding and transporting the forward end of each sheet of printing paper fed from the paper storage 27 by a reciprocating suction board 74. When the printing paper is transferred from the feed cylinder 16 to the impression cylinder 15, the gripper 573 of the impression cylinder 15 holds the forward end of the printing paper which has been held by the gripper 574 of the feed cylinder 16.

The paper discharge cylinder 17 disposed adjacent the impression cylinder 15 has the same diameter as the impression cylinder 15. The discharge cylinder 17 has a pair of chains 19 wound around opposite ends thereof. The chains 19 are interconnected by coupling members, not shown, having a plurality of grippers 575 which will also be described later in regards to FIGS. 17 and 21–32 arranged thereon. When the impression cylinder 15 transfers the printing paper to the discharge cylinder 17, one of the grippers 575 of the discharge cylinder 17 holds the forward end of the printing paper having been held by the gripper 573 of the impression cylinder 15.

With movement of the chains 19, the printing paper is transorted to the paper discharge station 28 to be discharged thereon.

The paper feed cylinder 16 is connected to a drive motor through a belt not shown. The paper feed cylinder 16, impression cylinder 15, paper discharge cylinder 17 and the first and second blanket cylinders 13 and 14 are coupled to one another by gears mounted on end portions thereof, respectively. Further, the first and second blanket cylinders 13 and 14 are coupled to the first and second plate cylinders 11 and 12 in the first and second printing positions, respectively, by gears mounted on end portions thereof. Thus, a motor, not shown, is operable to rotate the paper feed cylinder 16, impression cylinder 15, paper discharge cylinder 17, the first and second blanket cylinders 13 and 14 and the first and second plate cylinders 11 and 12 synchronously with one another.

Figure 5:
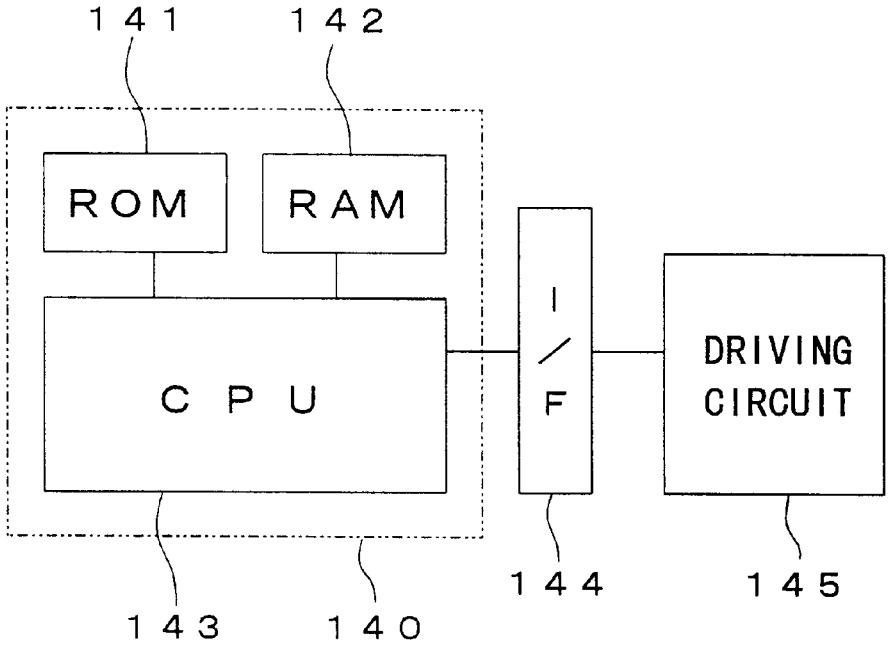
FIG. 5 is a block diagram showing a principal electrical structure of the printing apparatus.

FIG. 5 is a block diagram showing a principal electrical structure of the printing apparatus. This printing apparatus includes a control unit 140 having a ROM 141 for storing operating programs necessary for controlling the apparatus, a RAM 142 for temporarily storing data and the like during a control operation, and a CPU 143 for performing logic operations. The control unit 140 has a driving circuit 145 connected thereto through an interface 144, for generating driving signals for driving the ink feeders 20, image recorder 25, developing device 26, blanket cleaning unit 29, the moving mechanisms for moving the first and second plate cylinders 11 and 12, the contact mechanisms for the first and second blanket cylinders 13 and 14, and so on. The printing apparatus is controlled by the control unit 140 to execute prepress and printing operations as described hereinafter.

Figure 6:
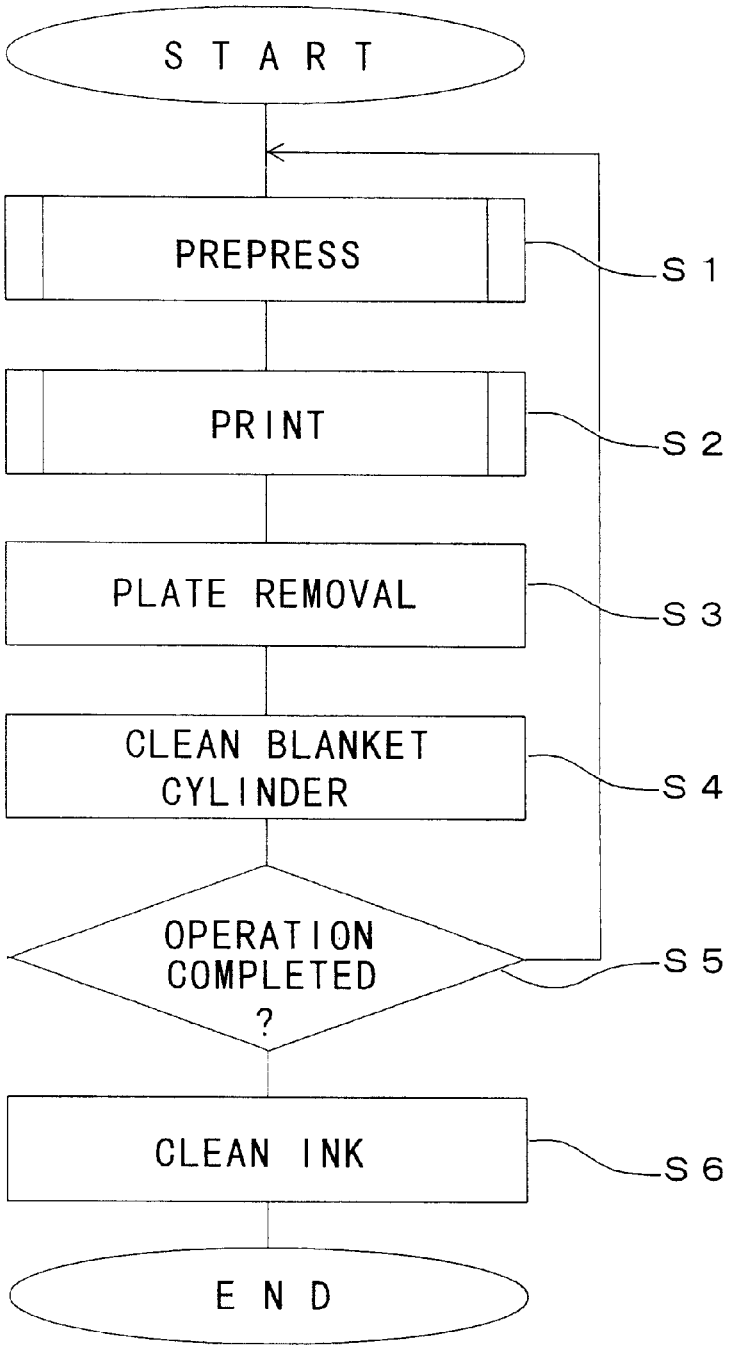
FIG. 6 is a flow chart showing an outline of prepress and printing operations of the printing apparatus.

The prepress and printing operations of the printing apparatus will be described next. FIG. 6 is a flow chart showing an outline of the prepress and printing operations of the printing apparatus.

Figure 7:
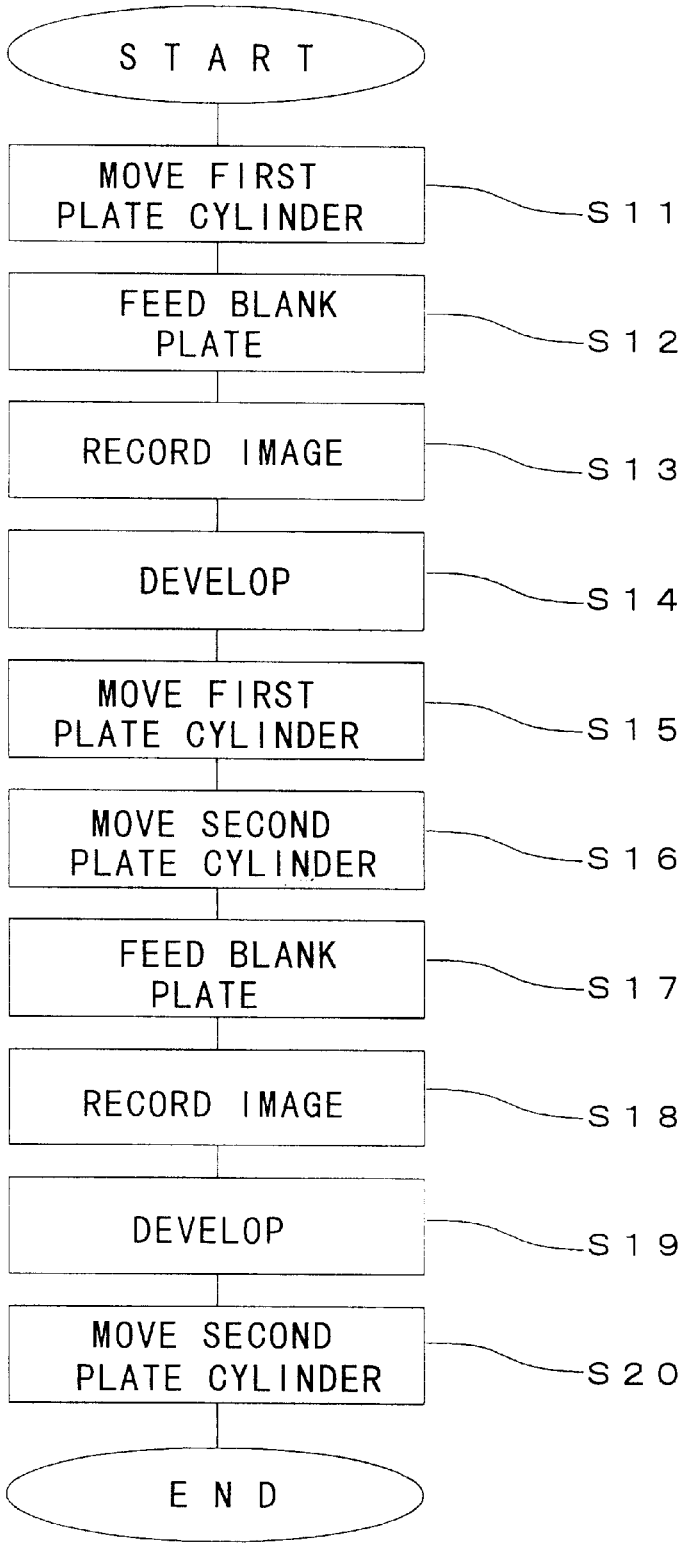
FIG. 7 is a flow chart of a prepress process.

First, the printing apparatus executes a prepress process for recording and developing images on the plates P mounted on the first and second plate cylinders 11 and 12 (step S1). This prepress process follows the steps constituting a subroutine as shown in the flow chart of FIG. 7.

The first plate cylinder 11 is first moved to a prepress position, i.e. the image recording position shown in a two-dot chain line in FIG. 1. (step S11).

Next, a plate P is fed to the outer periphery of the first plate cylinder 11 (step S12). To achieve the feeding of the plate P, the pair of grippers, not shown, grip the forward end of plate P drawn from the supply cassette 63, and the rear end of plate P cut by the cutter 66.

Then, an image is recorded on the plate P mounted peripherally of the first plate cylinder 11 (step S13). For recording the image, the image recorder 25 irradiates the plate P mounted peripherally of the first plate cylinder 11 with a modulated laser beam while the first plate cylinder 11 is rotated at low speed by the cylinder rotating mechanism not shown.

Next, the image recorded on the plate P is developed (step S14). The developing step is executed by raising the developing device 26 from the standby position shown in two-dot chain lines to the developing position shown in solid lines in FIG. 1 and thereafter successively moving the developing unit, fixing unit and squeezing unit into contact with the plate P rotating with the first plate cylinder 11.

Upon completion of the developing step, the first plate cylinder 11 is moved to the first printing position shown in the solid line in FIG. 1 (step S15).

Subsequently, the printing apparatus carries out an operation similar to steps S11 to S15 by way of a prepress process for the plate P mounted peripherally of the second plate cylinder 12 (steps S16 to S20). Completion of the prepress steps for the plates P mounted peripherally of the first and second plate cylinders 11 and 12 brings the prepress process to an end.

Referring again to FIG. 6, the prepress process is followed by a printing process for printing the printing paper with the plates P mounted on the first and second plate cylinders 11 and 12 (step S2). The operation of the printing apparatus in this printing process will be described in detail hereinafter.

Upon completion of the printing process, the plates P used in the printing are removed (step S3). To remove the plates P, the first plate cylinder 11 is first moved to the prepress position shown in the two-dot chain line in FIG. 1. Then, while the first plate cylinder 11 is rotated counterclockwise, the pawl mechanism 73 separates an end of the plate P from the first plate cylinder 11. The plate P separated is guided by the conveyor mechanism 69 into the discharge cassette 68. After returning the first plate cylinder 11 to the first printing position, the second plate cylinder 12 is moved from the second printing position to the prepress position to undergo an operation similar to the above, thereby having the plate P removed from the second plate cylinder 12 for discharge into the discharge cassette 68.

Upon completion of the plate removing step, the first and second blanket cylinders 13 and 14 are cleaned (step S4). For cleaning the first and second blanket cylinders 13 and 14, the contact mechanisms as shown in FIG. 4 separate the first and second blanket cylinders 13 and 14 from the first and second plate cylinders 11 and 12 and the impression cylinder 15. The first and second blanket cylinders 13 and 14 are thereafter rotated. In this state, the cleaning cloth of blanket cleaning unit 29 supplied with the cleaning solution is placed in contact with and slid on the surfaces of the first and second blanket cylinders 13 and 14, thereby cleaning the first and second blanket cylinders 13 and 14.

After completing the cleaning of the first and second blanket cylinders 13 and 14, the printing apparatus determines whether or not a further image is to be printed (step S5). If a further printing operation is required, the apparatus repeats steps S1 to S4.

If the printing operation is ended, the printing apparatus cleans the inks (step S6). For cleaning the inks, an ink cleaning device, not shown, provided for each ink feeder 20 removes the ink adhering to the ink rollers 71 and inkwell 72 of each ink feeder 20.

With completion of the ink cleaning step, the printing apparatus ends the entire process.

The operation of the printing apparatus in the above-mentioned printing process will be described next. In order to selectively perform four-color printing and monochromatic printing or two-color printing, as described hereinafter, this printing apparatus must control opening and closing of the gripper 573 on the impression cylinder 15, the gripper 574 on the paper feed cylinder 16, and the gripper 575 on the paper discharge cylinder 17. The construction of a gripper control mechanism according to the present invention for controlling the opening and closing of these grippers 573, 574 and 575 will be described in detail hereinafter.

A four-color printing operation using the four color inks of yellow, magenta, cyan and black will be described first.

FIGS. 8 through 12 are explanatory views showing a four-color printing operation of this printing apparatus. For expediency of illustration, these figures depict printing paper S having a length corresponding to the circumference of each of the impression cylinder 15, paper feed cylinder 16 and paper discharge cylinder 17. In practice, the length of printing paper S is greater than the circumference of each of the impression cylinder 15, paper feed cylinder 16 and paper discharge cylinder 17. Further, in FIGS. 8 through 12, for expediency of illustration again, reference K is affixed to regions of the first plate cylinder 11 and first blanket cylinder 13 used for printing with black ink, reference M to regions of the first plate cylinder 11 and first blanket cylinder 13 used for printing with magenta ink, reference C to regions of the second plate cylinder 12 and second blanket cylinder 14 used for printing with cyan ink, and reference Y to regions of the second plate cylinder 12 and second blanket cylinder 14 used for printing with yellow ink.

It is assumed that, in the prepress process preceding the printing process, as described hereinbefore, and as shown in FIG. 2A, the image areas 67*a* and 67*b* for printing with the black and magenta inks respectively are recorded on the plate P mounted peripherally of the first plate cylinder 11. Similarly, as shown in FIG. 2B, the image areas 67*c* and 67*d* for printing with the cyan and yellow inks respectively are assumed to be on the plate P mounted peripherally of the second plate cylinder 12.

As described hereinbefore, the ink feeders 20*a*, 20*b*, 20*c* and 20*d* are supplied with the black, magenta, cyan and yellow inks, respectively. Then, the ink feeders 20*a*, 20*b*, 20*c* and 20*d* are ready to feed the black, magenta, cyan and yellow inks to the image areas 67*a*, 67*b*, 67*c* and 67*d* on the plates P shown in FIGS. 2A and 2B, respectively.

First, each dampening water feeder 21 and each ink feeder 20 are placed in contact with only a corresponding one of the image areas on the plates P mounted on the first and second plate cylinders 11 and 12. Consequently, dampening water is fed to the image areas 67*a*, 67*b*, 67*c* and 67*d* from the corresponding water feeders 21*a*, 21*b*, 21*c* and 21*c*, and so are the black, magenta, cyan and yellow inks from the ink feeders 20*a*, 20*b*, 20*c* and 20*d*, respectively. These inks are transferred to the corresponding regions of the first and second blanket cylinders 13 and 14, respectively.

By repeating this operation, the inks are fed to the plates P mounted on the first and second plate cylinders 11 and 12 and to the first and second blanket cylinders 13 and 14. This ink feeding operation is repeated until the printing process is completed.

Figure 8:
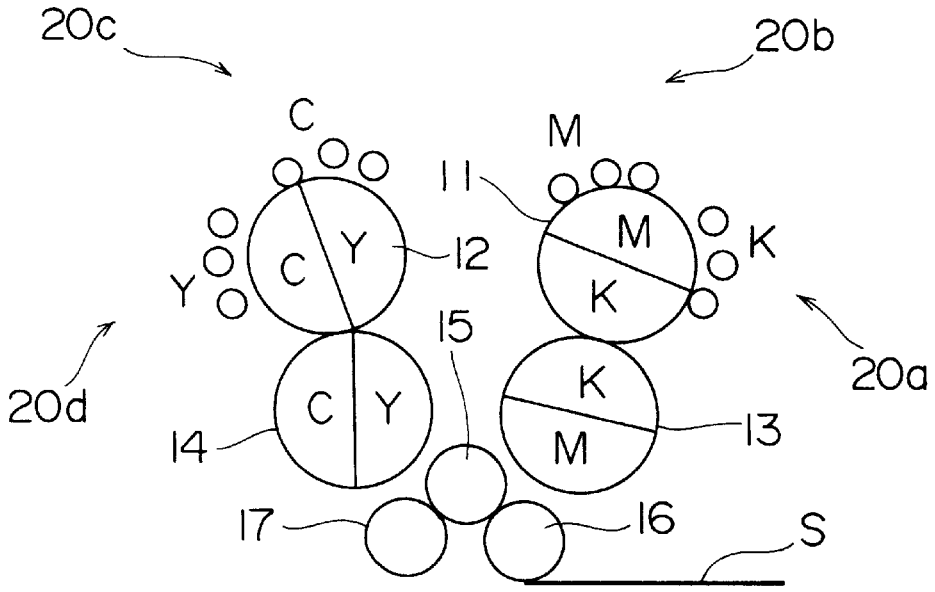
FIG. 8 is an explanatory view of the printing operation of the printing apparatus.

When the inks have been fed to the plates P mounted on the first and second plate cylinders 11 and 12 and to the first and second blanket cylinders 13 and 14, the printing paper S is fed to the paper feed cylinder 16 as shown in FIG. 8. The printing paper S is subsequently passed from the paper feed cylinder 16 to the impression cylinder 15.

Figure 9:
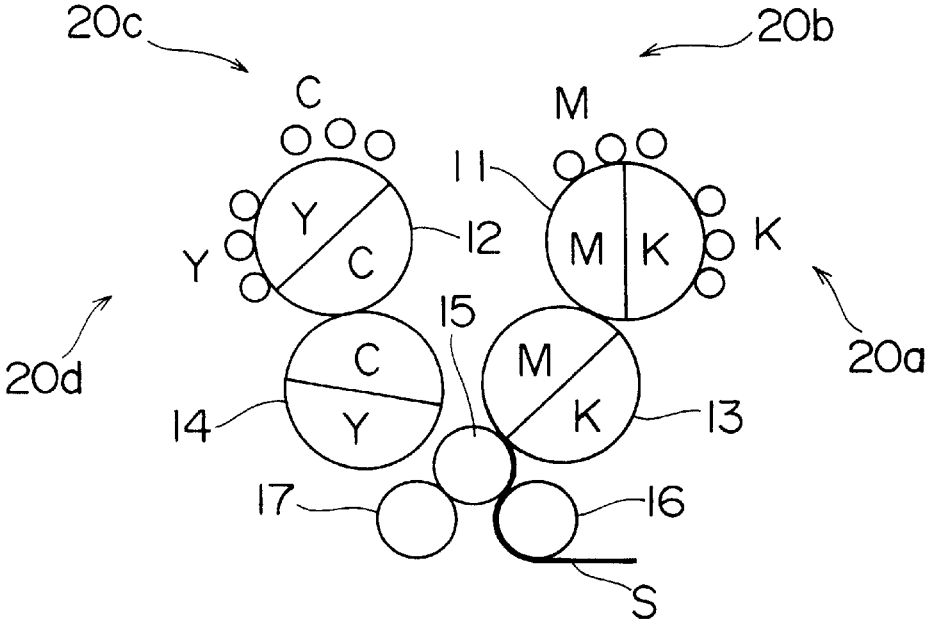
FIG. 9 is another explanatory view of the printing operation of the printing apparatus.

With a further rotation of the impression cylinder 15, the forward end of printing paper S mounted on the impression cylinder 15 reaches a position opposed to the first blanket cylinder 13. Then, the contact mechanism shown in FIG. 4 moves the first blanket cylinder 13 into contact with the impression cylinder 15. In this state, the forward end of printing paper S comes into contact with an end of the region of the first blanket cylinder 13 used for printing with the black ink, as shown in FIG. 9. The black ink has been transferred from the image area 67*a* of the plate P mounted on the first plate cylinder 11 to the region of the first blanket cylinder 13 used for printing with the black ink. Thus, the black ink is transferred to the printing paper S with a further rotation of the first blanket cylinder 13 and impression cylinder 15.

Figure 10:
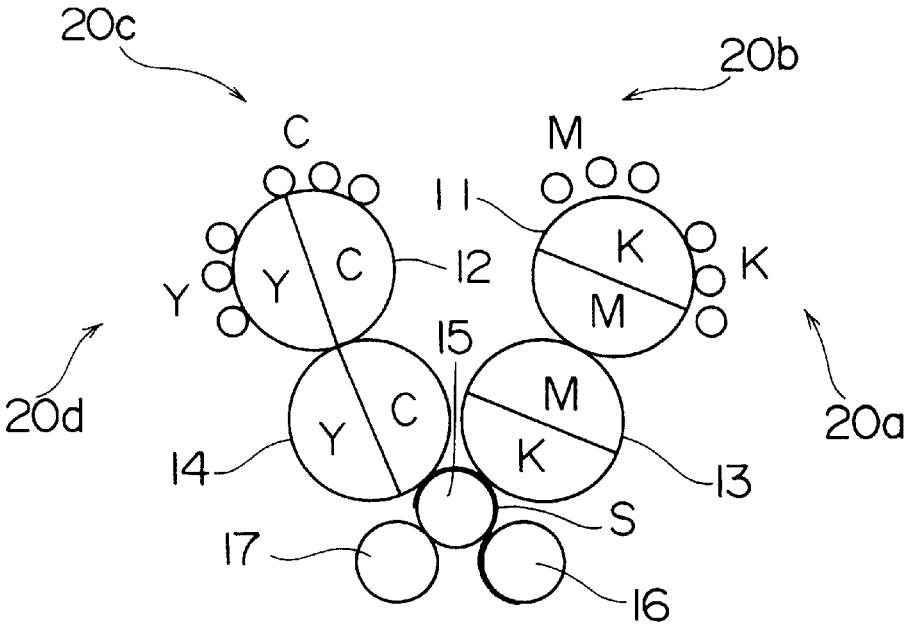
FIG. 10 is a further explanatory view of the printing operation of the printing apparatus.

With a still further rotation of the impression cylinder 15, the forward end of printing paper S mounted on the impression cylinder 15 reaches a position opposed to the second blanket cylinder 14. Then, the contact mechanism as shown in FIG. 4 moves the second blanket cylinder 14 into contact with the impression cylinder 15. In this state, the forward end of printing paper S comes into contact with an end of the region of the second blanket cylinder 14 used for printing with the cyan ink, as shown in FIG. 10. The cyan ink has been transferred from the image area 67*c* of the plate P mounted on the second plate cylinder 12 to the region of the second blanket cylinder 13 used for printing with the cyan ink. Thus, with a further rotation of the second blanket cylinder 14 and impression cylinder 15, the cyan ink is transferred to the printing paper S to which the black ink has already been transferred.

Figure 11:
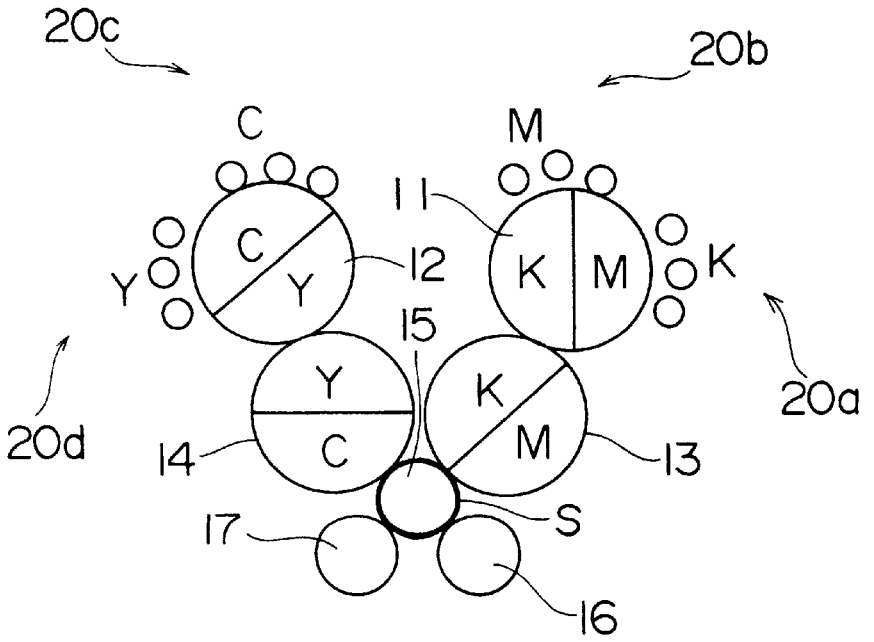
FIG. 11 is a still further explanatory view of the printing operation of the printing apparatus.

As the impression cylinder 15 continues to rotate with the first and second blanket cylinders 13 and 14 in this state, the printing paper S becomes completely wrapped around the impression cylinder 15 as shown in FIG. 11. Since the impression cylinder 15 has half the diameter of the first and second plate cylinders 11 and 12 and the first and second blanket cylinders 13 and 14, the printing paper S wrapped around the impression cylinder 15 comes, in its second rotation, into contact with the region of the first blanket cylinder 13 used for printing with the magenta ink. The magenta ink has been transferred from the image area 67*b* of the plate P mounted on the first plate cylinder 11 to the region of the first blanket cylinder 13 used for printing with the magenta ink. Thus, with a further rotation of the first blanket cylinder 13 and impression cylinder 15, the magenta ink is transferred to the printing paper S to which the black and cyan inks have already been transferred.

With a still further rotation of the impression cylinder 15, the printing paper S comes into contact with an end of the region of the second blanket cylinder 14 used for printing with the yellow ink. The yellow ink has been transferred from the image area 67*d* of the plate P mounted on the second plate cylinder 12 to the region of the second blanket cylinder 14 used for printing with the yellow ink. With a further rotation of the second blanket cylinder 14 and impression cylinder 15, therefore, the yellow ink is transferred to the printing paper S to which the black, cyan and magenta inks have already been transferred. This completes the four-color printing.

Figure 12:
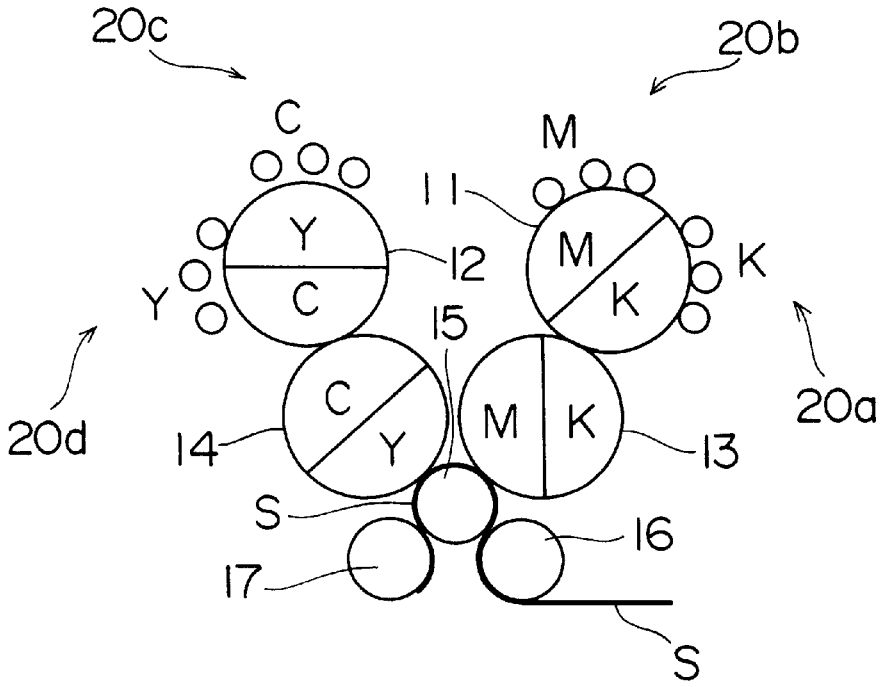
FIG. 12 is a still further explanatory view of the printing operation of the printing apparatus.

As shown in FIG. 12, the forward end of printing paper S printed in the four colors is passed from the impression cylinder 15 to the paper discharge cylinder 17. Meanwhile, printing paper S to be printed next is fed to the paper feed cylinder 16, and then transferred from the feed cylinder 16 to the impression cylinder 15.

Figure 13:
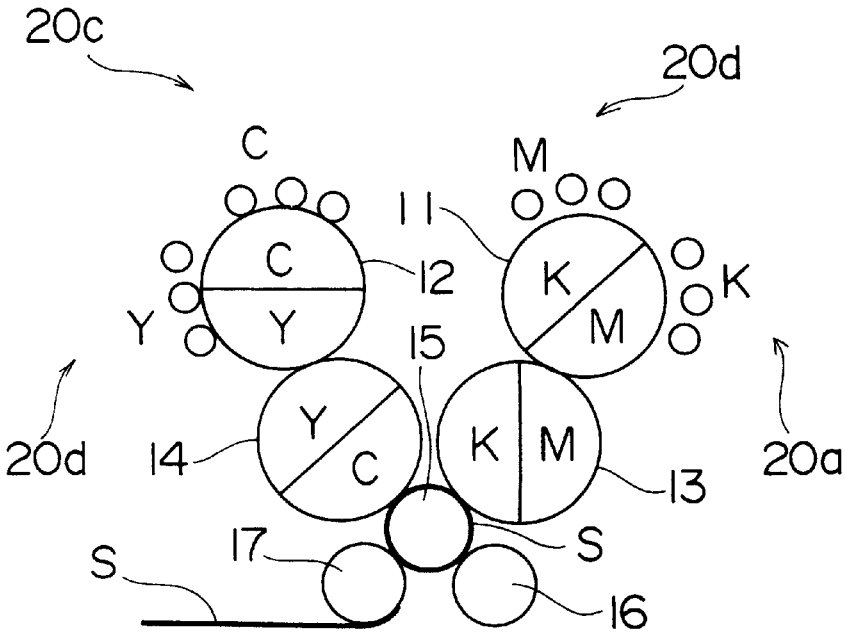
FIG. 13 is a still further explanatory view of the printing operation of the printing apparatus.

The printing paper S printed in the four colors is transported by the pair of chains 19 to the paper discharge station 28 along with one of the grippers 575 of the paper discharge cylinder 17, as shown in FIG. 13.

As described above, the impression cylinder 15 has half the diameter of the first and second plate cylinders 11 and 12 and the first and second blanket cylinders 13 and 14. Consequently, the impression cylinder 15 rotates twice as the first and second plate cylinders 11 and 12 and the first and second blanket cylinders 13 and 14 rotate once. The printing paper S mounted peripherally of the impression cylinder 15 is printed in the four colors of yellow, magenta, cyan and black while the impression cylinder 15 rotates twice. Thus, the printing apparatus can continuously execute the four-color printing by feeding a new sheet of printing paper S from the paper feed cylinder 16 for every two rotations of the impression cylinder 15.

A monochromatic printing operation using one of the four color inks of yellow, magenta, cyan and black will be described next.

When this printing apparatus performs printing with only the black ink, for example, the same image is formed in the image areas 67*a* and 67*b* on the plate P mounted on the first plate cylinder 11. The ink feeder 20*a* is arranged to feed the black ink to both of the image areas 67*a* and 67*b*. The other ink feeders 20*b*, 20*c* and 20*d* are kept away from the first and second plate cylinders 11 and 12. Further, the contact mechanisms as shown in FIG. 4 places the first blanket cylinder 13 in contact with the impression cylinder 15, and the second blanket cylinder 14 out of contact with the impression cylinder 15.

In this state, a new sheet of printing paper S is fed from the paper feed cylinder 16 for every rotation of the impression cylinder 15. As a result, with every rotation of the impression cylinder 15, the image in the black ink is transferred from the image area 67*a* or 67*b* in which the same image is formed to the printing paper S mounted peripherally of the impression cylinder 15, to achieve monochromatic printing.

A two-color printing operation using one of the magenta and black inks and one of the yellow and cyan inks will be described next.

When this printing apparatus performs printing with the black and cyan inks, for example, the same image is formed in the image areas 67*a* and 67*b* on the plate P mounted on the first plate cylinder 11, and the same image in the image areas 67*c* and 67*d* on the plate P mounted on the second plate cylinder 12. The ink feeder 20*a* is arranged to feed the black ink to both of the image areas 67*a* and 67*b*, while the ink feeder 20*c* is arranged to feed the cyan ink to both of the image areas 67*c* and 67*d*. The other ink feeders 20*b* and 20*d* are kept away from the first and second plate cylinders 11 and 12. Further, the contact mechanisms as shown in FIG. 4 place the first and second blanket cylinder 13 and 14 in contact with the impression cylinder 15.

In this state, a new sheet of printing paper S is fed from the paper feed cylinder 16 for every rotation of the impression cylinder 15. As a result, with every rotation of the impression cylinder 15, the image in the black ink is transferred from the image area 67*a* or 67*b* in which the same image is formed to the printing paper S mounted peripherally of the impression cylinder 15, and thereafter the image in the cyan ink is transferred from the image area 67*c* or 67*d* in which the same image is formed to the printing paper S. Thus, a two-colors print is made on the printing paper S.

As noted above, when executing four-color printing, monochromatic printing or two-color printing, this apparatus must control opening and closing of the gripper 573 on the impression cylinder 15, the gripper 574 on the paper feed cylinder 16 and the grippers 575 on the paper discharge cylinder 17.

Figure 14:
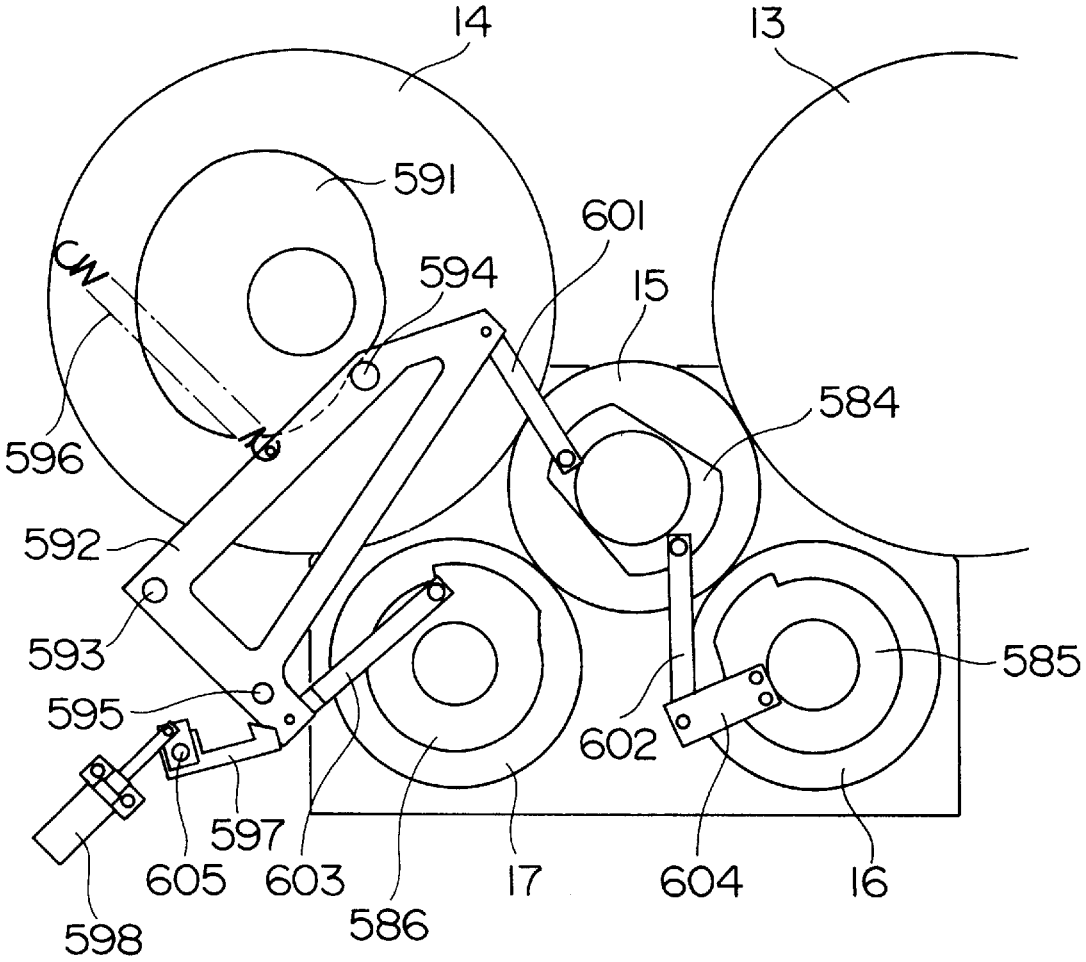
FIG. 14 is a schematic view of a gripper control mechanism for opening and closing grippers.
Figure 15:
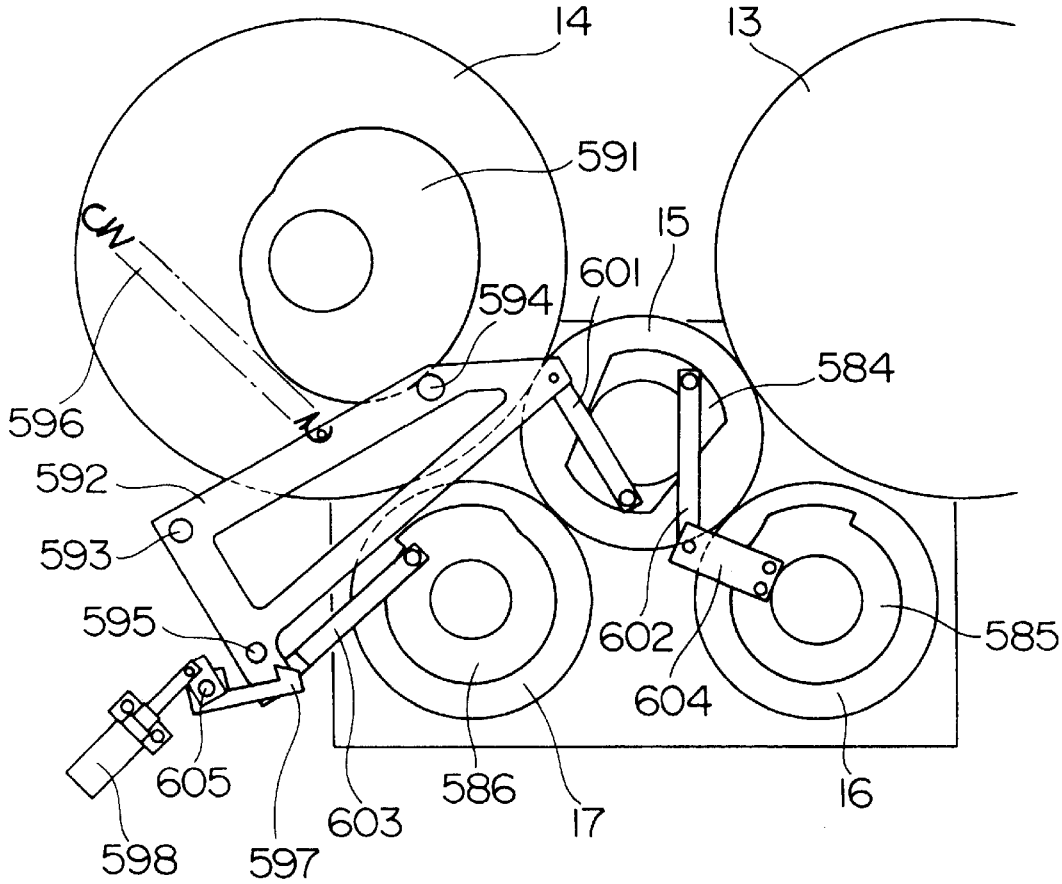
FIG. 15 is another schematic view of the gripper control mechanism for opening and closing the grippers.
Figure 16:
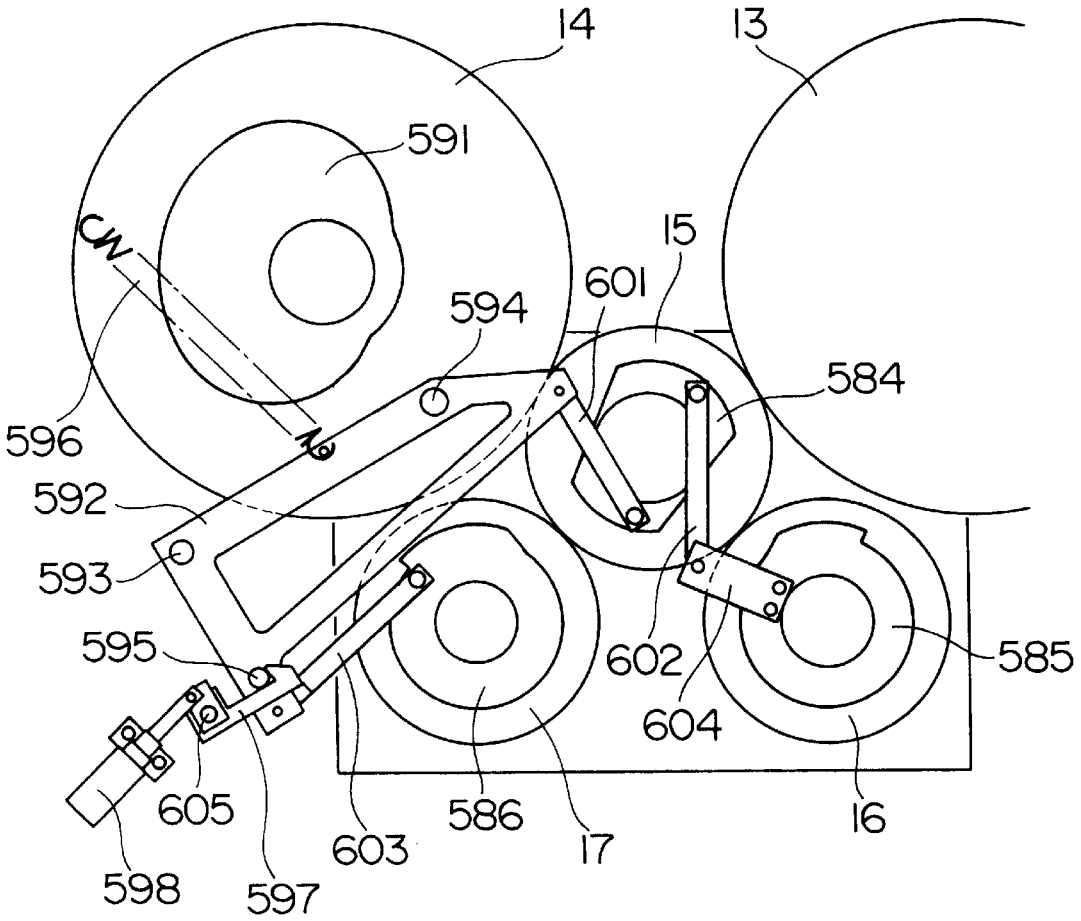
FIG. 16 is a further schematic view of the gripper control mechanism for opening and closing the grippers.

The gripper control mechanism of the present invention for controlling opening and closing of these grippers 573, 574 and 575 will be described hereinafter. FIGS. 14 through 16 are schematic views of the gripper control mechanism for opening and closing the grippers 573, 574 and 575.

The gripper control mechanism for opening and closing the grippers 573, 574 and 575 includes a link mechanism having a main link 592 pivotable about a main link axis 593. The main link 592 has a cam follower 594 in contact with a cam 591 mounted coaxially with the second blanket cylinder 14. The main link 592 is biased by a spring 596 in a direction to press the cam follower 594 upon the cam 591. Thus, the main link 592 is pivotable about the main link axis 593 as the cam 591 rotates synchronously with the second blanket cylinder 14.

A movable cam 584 is disposed laterally of the impression cylinder 15 to be rotatable about the axis of the impression cylinder 15. A movable cam 585 is disposed laterally of the paper feed cylinder 16 to be rotatable about the axis of the paper feed cylinder 16. Further, a movable cam 586 is disposed laterally of the paper discharge cylinder 17 to be rotatable about the axis of the paper discharge cylinder 17. The movable cam 584 disposed laterally of the impression cylinder 15 is connected to the main link 592 through a link 601. The movable cam 585 disposed laterally of the paper feed cylinder 16 is connected to the movable cam 585 through a link 602 and a coupling plate 604. The movable cam 586 disposed laterally of the paper discharge cylinder 17 is connected to the main link 592 through a link 603.

With the above construction, when the cam follower 594 of the main link 592 contacts a recess of the cam 591, the main link 592 and the movable cams 584, 585 and 586 are arranged in the position shown in FIG. 14. When, in this state, the second blanket cylinder 14 rotates with the first blanket cylinder 13 and impression cylinder 15, the cam 591 pushes the cam follower 594 of the main link 592, whereby the main link 592 pivots about the main link axis 593 clockwise in FIG. 14.

With the pivotal movement of the main link 592, the movable cam 584 connected to the main link 592 through the link 601 rotates about the axis of the impression cylinder 15 counterclockwise in FIG. 14. The rotation of the movable cam 584 causes the movable cam 585 connected to the movable cam 584 through the link 602 and coupling plate 604 to rotate about the axis of the paper feed cylinder 16 clockwise in FIG. 14. The pivotal movement of the main link 592 also causes the movable cam 586 connected to the main link 592 through the link 603 to rotate about the axis of the paper discharge cylinder 17 counterclockwise in FIG. 14.

Consequently, when the cam follower 594 of the main link 592 contacts a bulge of the cam 591, the main link 592 and the movable cams 584, 585 and 586 are arranged in the position shown in FIG. 15. The main link 592 and movable cams 584, 585 and 586 reciprocate between the position shown in FIG. 14 and the position shown in FIG. 15 as the cam 591 makes one rotation with the second blanket cylinder 14, i.e. as the impression cylinder 15 makes two rotations.

A stopper 597 is disposed below the main link 592 to be swingable by a solenoid 598 about an axis 605. The stopper 597 is engageable with a pin 595 projecting from the main link 592 to hold the main link 592 against pivotal movement.

To prohibit pivotal movement of the main link 592, the solenoid 598 is operated to swing the stopper 597 counterclockwise about the axis 605. When, in this state, the cam 591 causes the main link 592 to pivot to the position shown in FIG. 15, the distal end of stopper 597 engages the pin 595 projecting from the main link 592 as shown in FIG. 16. Then, the main link 592 is locked to the position shown in FIG. 16 regardless of the rotating angle of cam 591. Each of the movable cams 584, 585 and 586 is locked to the same state as where the cam follower 594 of the main link 592 is in contact with the bulge of the cam 591.

Constructions of fixed cams 587, 588 and 589 and grippers 573, 574 and 575 arranged in a corresponding relationship to the above movable cams 584, 585 and 586 will be described next.

Figure 17:
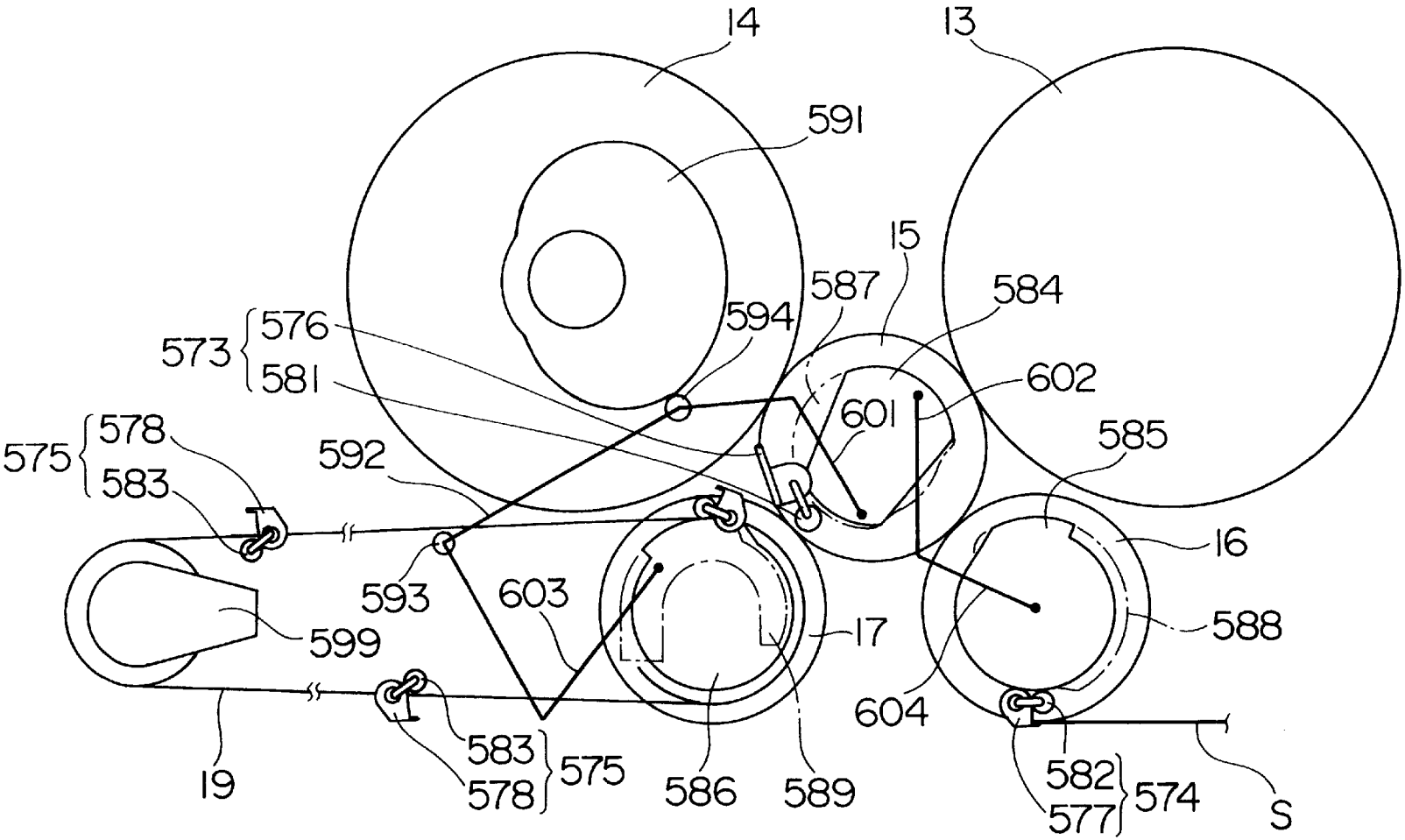
FIG. 17 is a schematic view showing the gripper control mechanism along with fixed cams and the grippers.

FIG. 17 is a schematic view showing the gripper control mechanism along with the fixed cams and grippers. FIG. 17 shows the movable cams 584, 585 and 586 in solid lines, and the fixed cams 587, 588 and 589 in two-dot chain lines. Further, the links 592, 601, 602 and 603 and coupling plate 604 shown in FIGS. 14 through 16 are depicted in a simplified form in FIG. 17.

Figure 18:
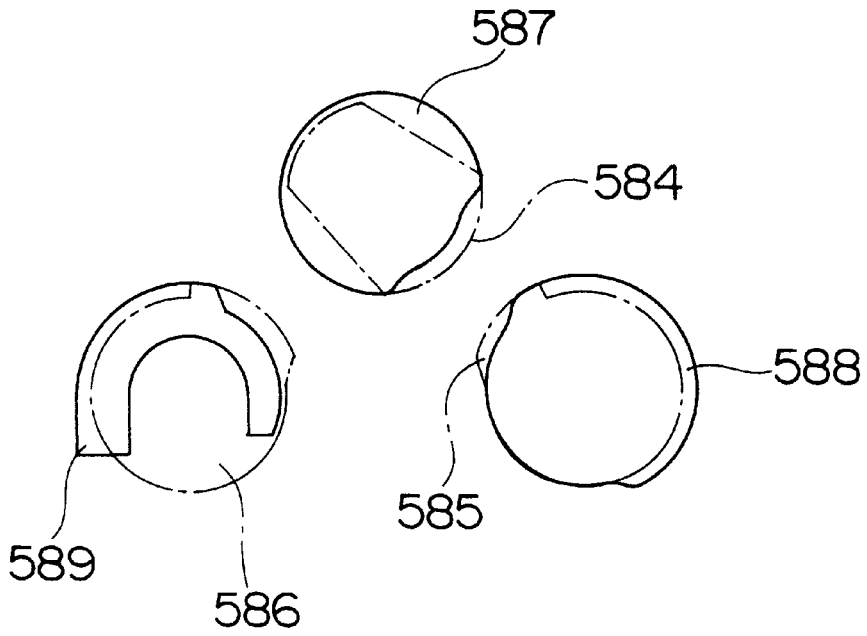
FIG. 18 is an explanatory view of a positional relationship among movable cams and fixed cams.
Figure 19:
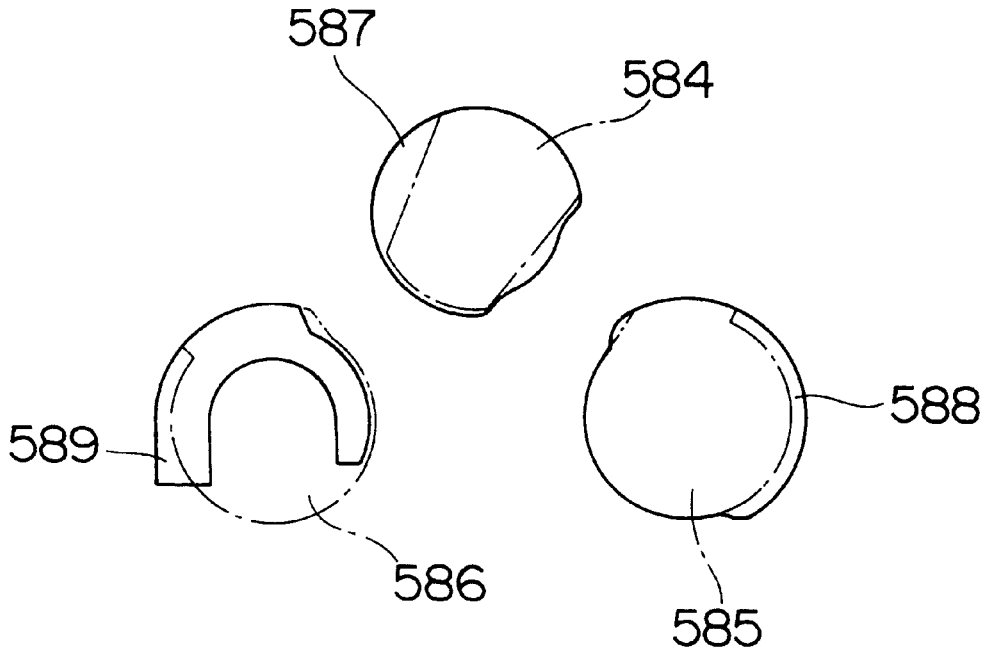
FIG. 19 is another explanatory view of the positional relationship among movable cams and fixed cams.

FIGS. 18 and 19 are explanatory views of a positional relationship among the movable cams 584, 585 and 586 and fixed cams 587, 588 and 589. FIG. 18 shows a state where the main link 592 is disposed in the position shown in FIG. 14. FIG. 19 shows a state where the main link 592 is disposed in the position shown in FIG. 15. FIGS. 18 and 19 show the movable cams 584, 585 and 586 two-dot chain lines, and the fixed cams 587, 588 and 589 in solid lines.

As shown in these figures, the fixed cam 587 is disposed laterally of and coaxially with the movable cam 584 disposed laterally of the impression cylinder 15. The fixed cam 588 is disposed laterally of and coaxially with the movable cam 585 disposed laterally of the paper feed cylinder 16. Further, the fixed cam 589 is disposed laterally of and coaxially with the movable cam 586 disposed laterally of the paper discharge cylinder 17.

The impression cylinder 15 has the gripper 573 including a blade 576 and a cam follower 581 attached to the blade 576. The gripper 573 is rotatable with the impression cylinder 15 to move the cam follower 581 into contact with the bulge of the movable cam 584 or fixed cam 587, thereby to close the blade 576.

The paper feed cylinder 16 has the gripper 574 including a blade 577 and a cam follower 582 attached to the blade 577. The gripper 574 is rotatable with the paper feed cylinder 16 to move the cam follower 582 into contact with the bulge of the movable cam 585 or fixed cam 588, thereby to open the blade 576.

Further, the chains 19 wound around the opposite ends of the paper discharge cylinder 17 have the plurality of grippers 575 each including a blade 578 and a cam follower 583 attached to the blade 578. With rotation of the paper feed cylinder 16, each gripper 575 is movable with the chains 19 to move the cam follower 583 into contact with the bulge of the movable cam 586 or fixed cam 589, thereby to open the blade 578. Each gripper 575 opens the blade 578 when the cam follower 583 contacts a contact piece 599 disposed above the paper discharge station 28 shown in FIG. 1.

Operations of the above printing apparatus for transferring the printing paper S will be described next. FIGS. 20 through 32 are explanatory views showing the printing paper transfer operations. The links 592, 601, 602 and 603 and coupling plate 604 shown in FIGS. 14 through 16 are depicted in a simplified form in FIGS. 20 through 32 also.

First, a printing paper transfer operation in printing the printing paper S with the four color inks of yellow, magenta, cyan and black will be described. In this case, as noted hereinbefore, the printing paper S must be fed from the paper feed cylinder 16 to the impression cylinder 15 for every two rotations of the impression cylinder 15.

In this case, the solenoid 598 is operated to hold the stopper 597 in the position shown in FIGS. 14 and 15, to render the main link 592 pivotable.

Figure 20:
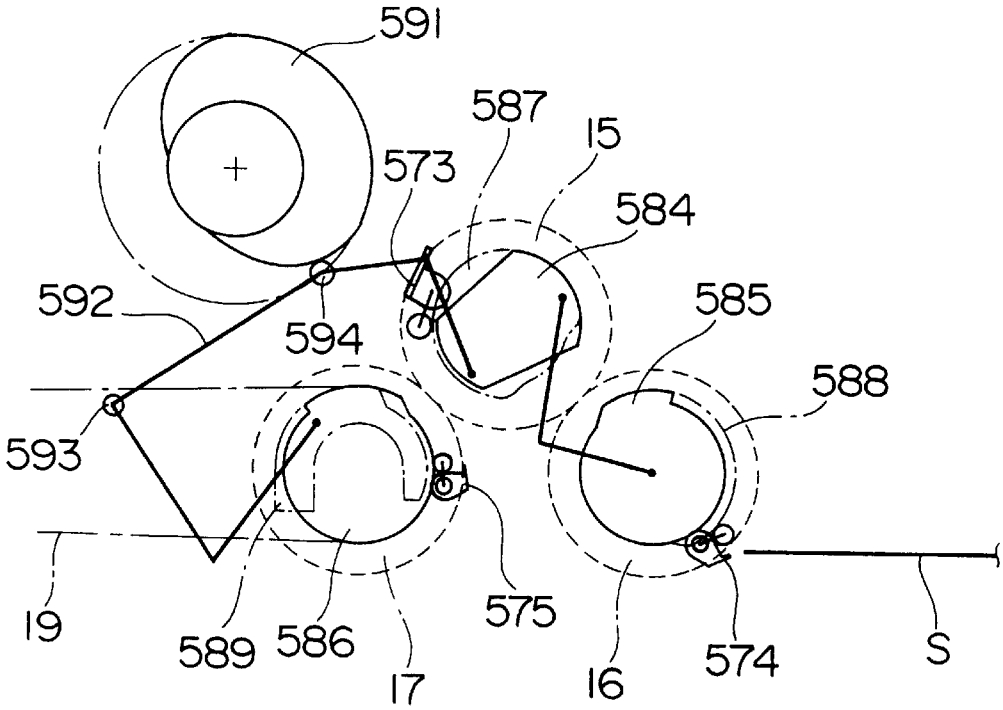
FIG. 20 is an explanatory view of a printing paper transfer operation.

Then, printing paper S is drawn from the paper storage 27 by action of the suction board 74 shown in FIG. 1. As shown in FIG. 20, the forward end of printing paper S is transported toward the gripper 574 on the paper feed cylinder 16. At this time, the cam follower 582 of the gripper 574 is in contact with the bulge of the fixed cam 588 to maintain the gripper 574 open.

Figure 21:
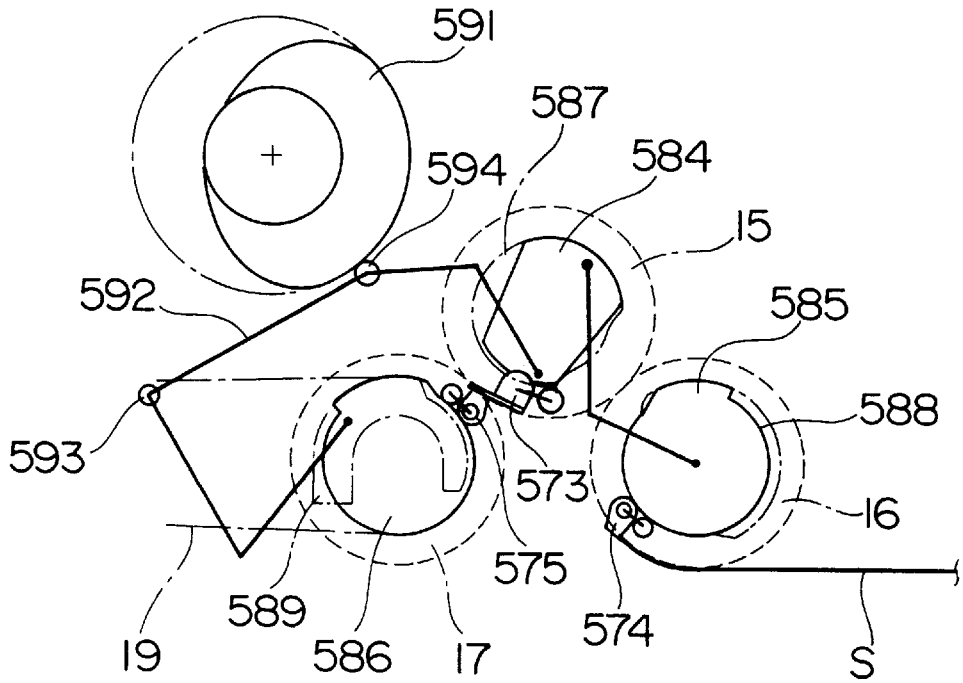
FIG. 21 is another explanatory view of the printing paper transfer operation.

In this state, the paper feed cylinder 16 rotates to move the cam follower 582 of the gripper 574 past the bulge of the fixed cam 588. Then, as shown in FIG. 21, the gripper 574 closes to grip the forward end of printing paper S.

Figure 22:
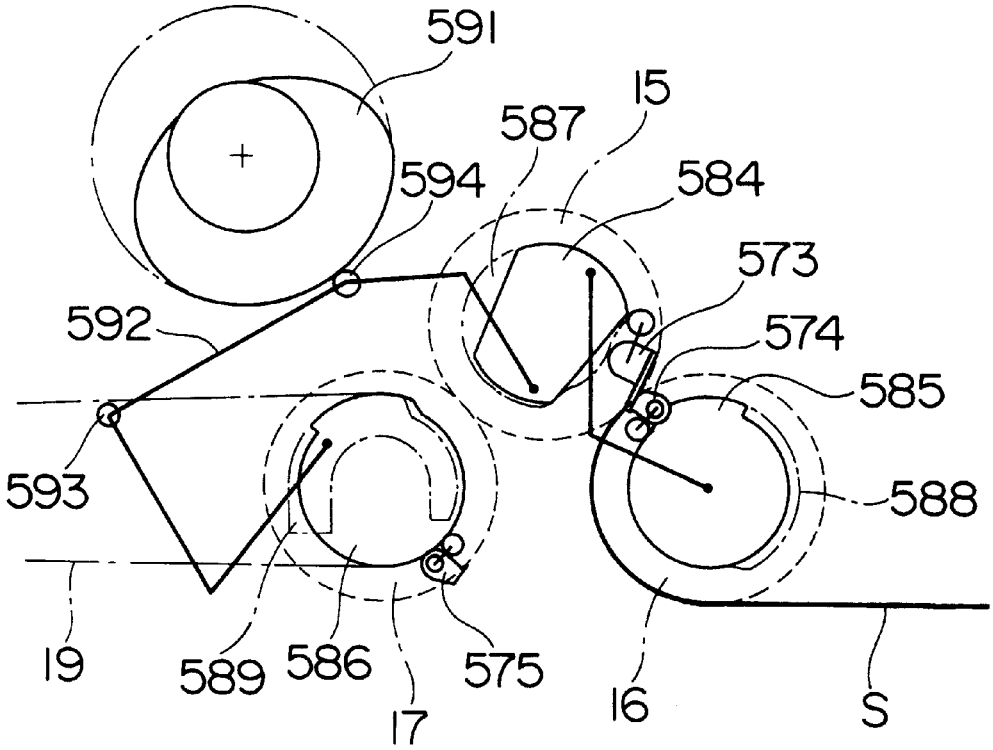
FIG. 22 is a further explanatory view of the printing paper transfer operation.

With a further rotation of the paper feed cylinder 16, the gripper 574 on the paper feed cylinder 16 moves to a position opposed to the gripper 573 on the impression cylinder 15 as shown in FIG. 22. Then, the cam follower 582 of the gripper 574 starts opening the gripper 574 by the action of fixed cam 588, while the cam follower 581 of the gripper 573 contacts the bulge of fixed cam 587 to start closing the gripper 573. As a result, the forward end of printing paper S is transferred from the gripper 574 to the gripper 573.

Figure 23:
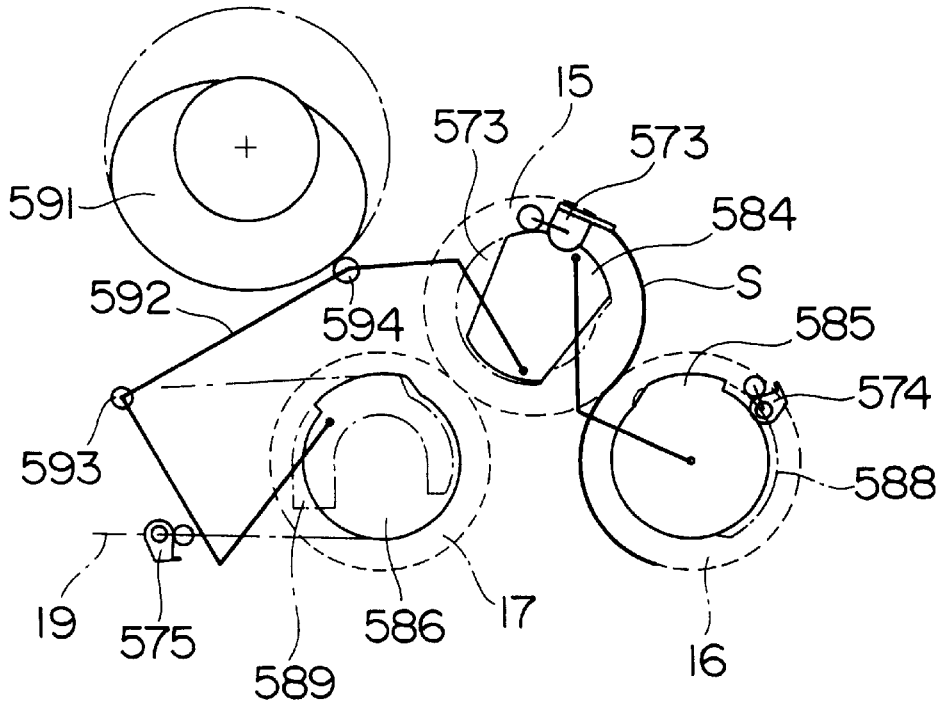
FIG. 23 is a still further explanatory view of the printing paper transfer operation.

With rotation of the impression cylinder 15 in this state, the first printing process is started for the printing paper S mounted on the impression cylinder 15. In this state, as shown in FIG. 23, the cam follower 581 of the gripper 573 remains in contact with the bulge of the fixed cam 587, whereby the forward end of printing paper S remains gripped.

Figure 24:
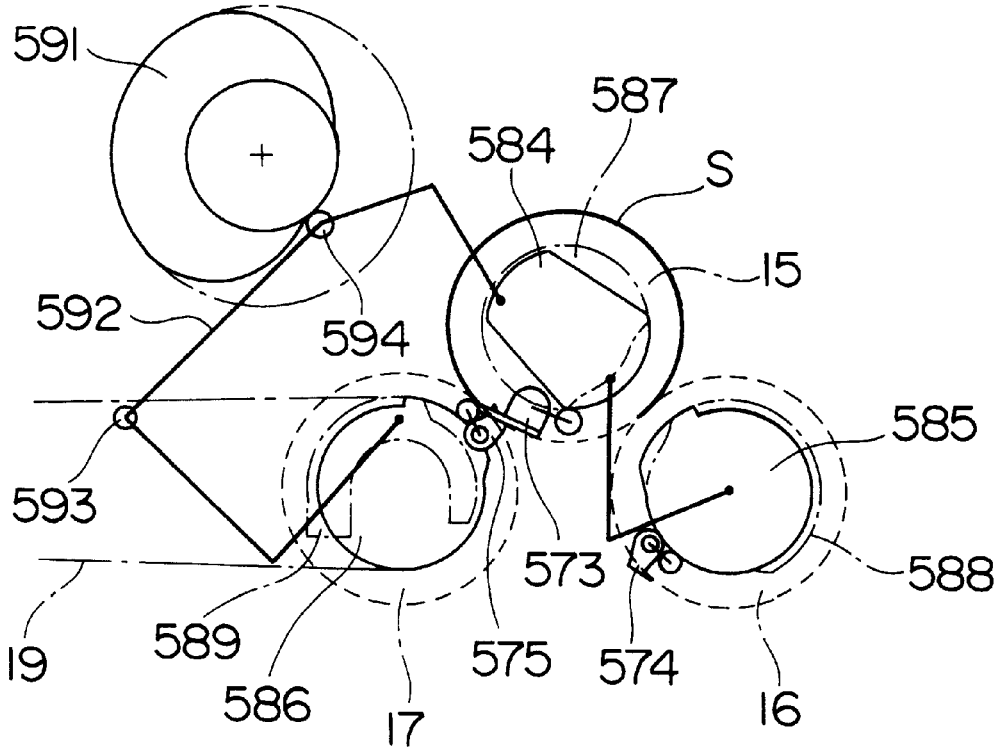
FIG. 24 is a still further explanatory view of the printing paper transfer operation.

FIG. 24 shows a state where, with a further rotation of the impression cylinder 15, the gripper 573 on the impression cylinder 15 has moved to a position opposed to one of the grippers 575 on the paper discharge cylinder 17. In the illustrated state, the cam follower 594 of the main link 592 is in contact with the recess of the cam 591. Thus, the movable cams 584, 585 and 586 and fixed cams 587, 588 and 589 are in the positional relationship shown in FIG. 18. Consequently, the cam follower 581 of the gripper 573 on the impression cylinder 15 is in contact with the movable cam 584 to maintain the gripper 573 closed. The cam follower 583 of the gripper 575 on the paper discharge cylinder 17 is in contact with the movable cam 586 to maintain the gripper 575 open. Therefore, the printing paper S is not transferred from the gripper 573 to the gripper 575.

Figure 25:
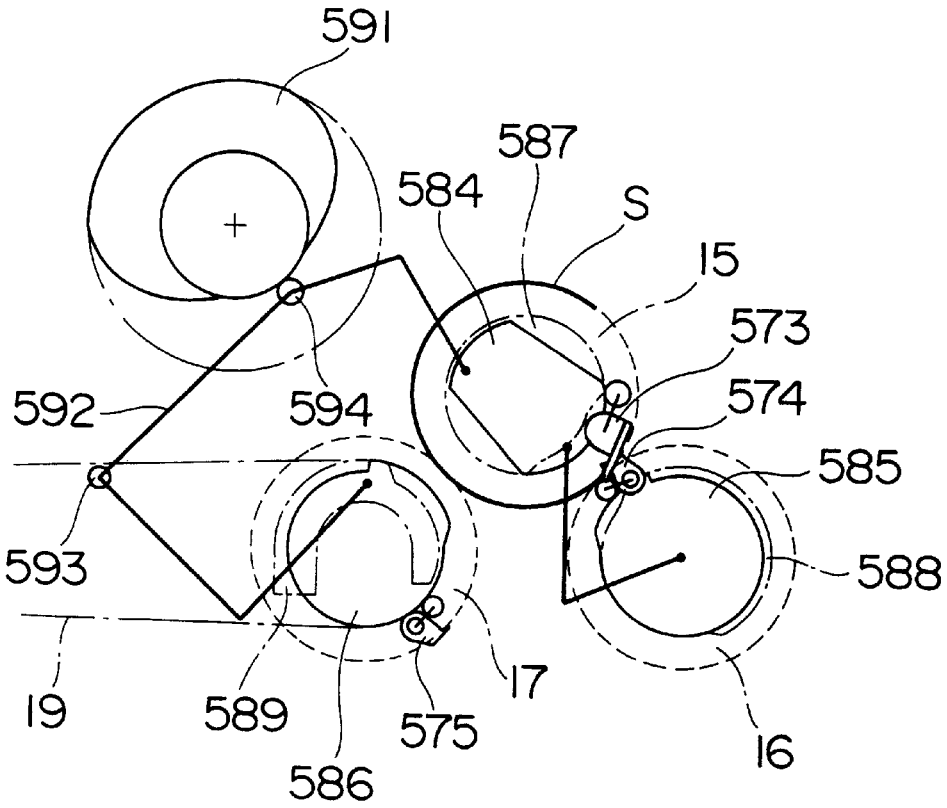
FIG. 25 is a still further explanatory view of the printing paper transfer operation.

FIG. 25 shows a state where, with a further rotation of the impression cylinder 15, the gripper 573 on the impression cylinder 15 has moved to a position opposed to the gripper 574 on the paper feed cylinder 16. In this state also, the cam follower 594 of the main link 592 is in contact with the recess of the cam 591 to maintain the movable cams 584, 585 and 586 and fixed cams 587, 588 and 589 in the positional relationship shown in FIG. 18. Consequently, the cam follower 581 of the gripper 573 on the impression cylinder 15 is in contact with the movable cam 584 to maintain the gripper 573 closed. The cam follower 582 of the gripper 574 on the paper feed cylinder 16 is in contact with the movable cam 585 to maintain the gripper 574 closed. Therefore, the two grippers 573 and 574 remain closed when opposed to each other.

Figure 26:
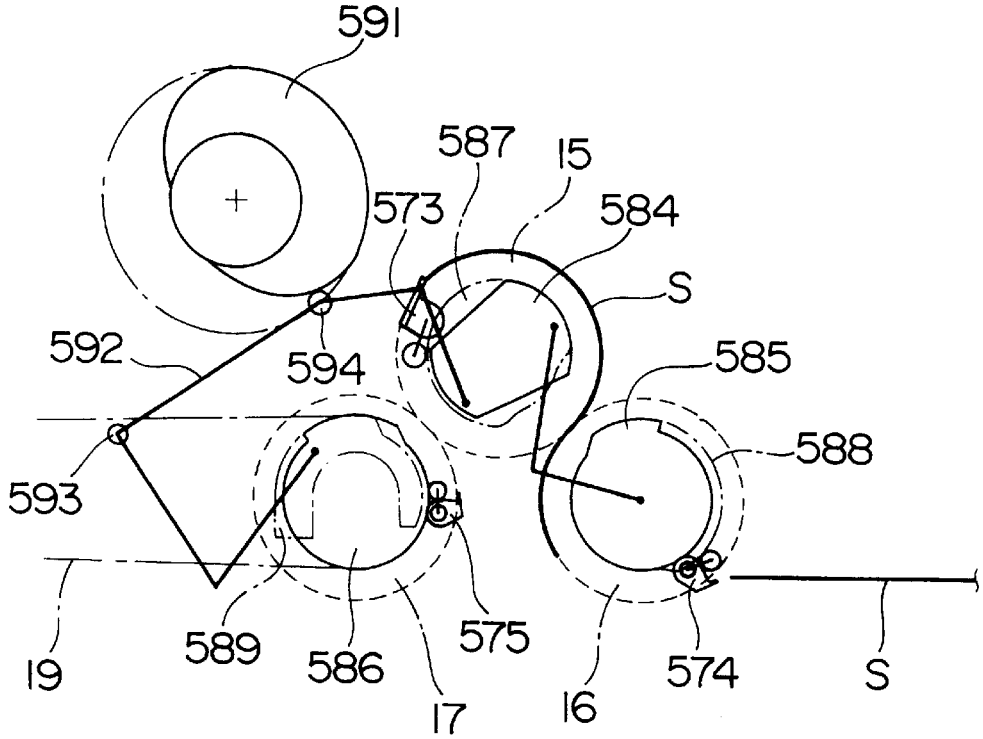
FIG. 26 is a still further explanatory view of the printing paper transfer operation.

With a further rotation of the impression cylinder 15 in this state, the second printing process is started for the printing paper S mounted on the impression cylinder 15. In this state, as shown in FIG. 26, the cam follower 581 of the gripper 573 remains in contact with the bulge of the fixed cam 587, whereby the forward end of printing paper S remains gripped. In this state, a second sheet of printing paper S is fed to the paper feed cylinder 16. At this time, the cam follower 582 of the gripper 574 on the paper feed cylinder 16 is in contact with the bulge of the fixed cam 588 to maintain the gripper 574 open.

Figure 27:
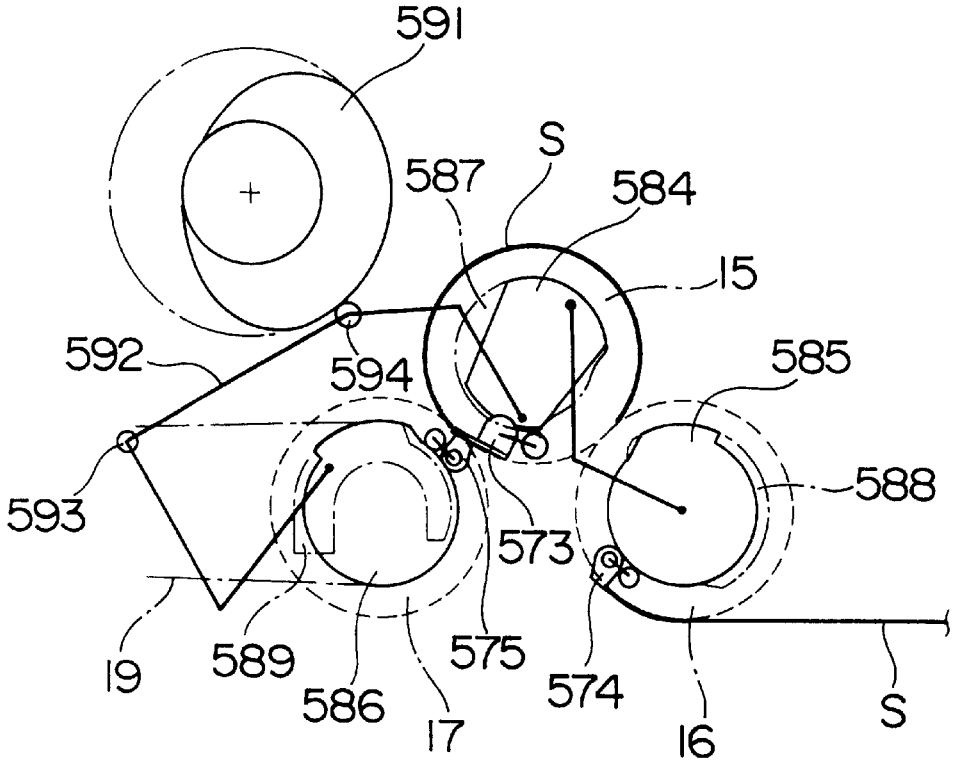
FIG. 27 is a still further explanatory view of the printing paper transfer operation.

FIG. 27 shows a state where, with a further rotation of the impression cylinder 15, the gripper 573 on the impression cylinder 15 has moved to the position opposed to the gripper 575 on the paper discharge cylinder 17. In the illustrated state, as distinct from the state shown in FIG. 24, the cam follower 594 of the main link 592 is in contact with the bulge of the cam 591. Thus, the movable cams 584, 585 and 586 and fixed cams 587, 588 and 589 are in the positional relationship shown in FIG. 19. Consequently, the cam follower 581 of the gripper 573 on the impression cylinder 15 contacts the recess of the movable cam 584 to start opening the gripper 573. The cam follower 583 of the gripper 575 on the paper discharge cylinder 17 contacts the recess of the movable cam 586 to start closing the gripper 575. As a result, the printing paper S is transferred from the gripper 573 to the gripper 575.

Figure 28:
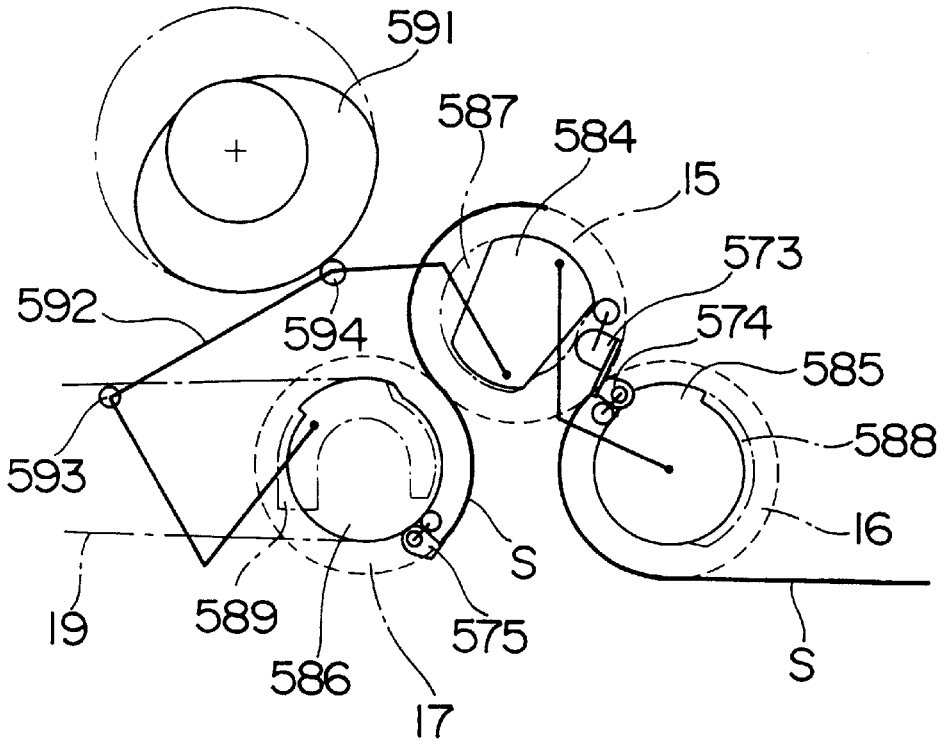
FIG. 28 is a still further explanatory view of the printing paper transfer operation.

With a further rotation of the paper discharge cylinder 17 in this state, the printing paper S is transported with the forward end thereof gripped by the gripper 575 as shown in FIG. 28. As in the case shown in FIG. 22, the forward end of the second sheet of printing paper S is transferred from the gripper 574 to the gripper 573.

Figure 29:
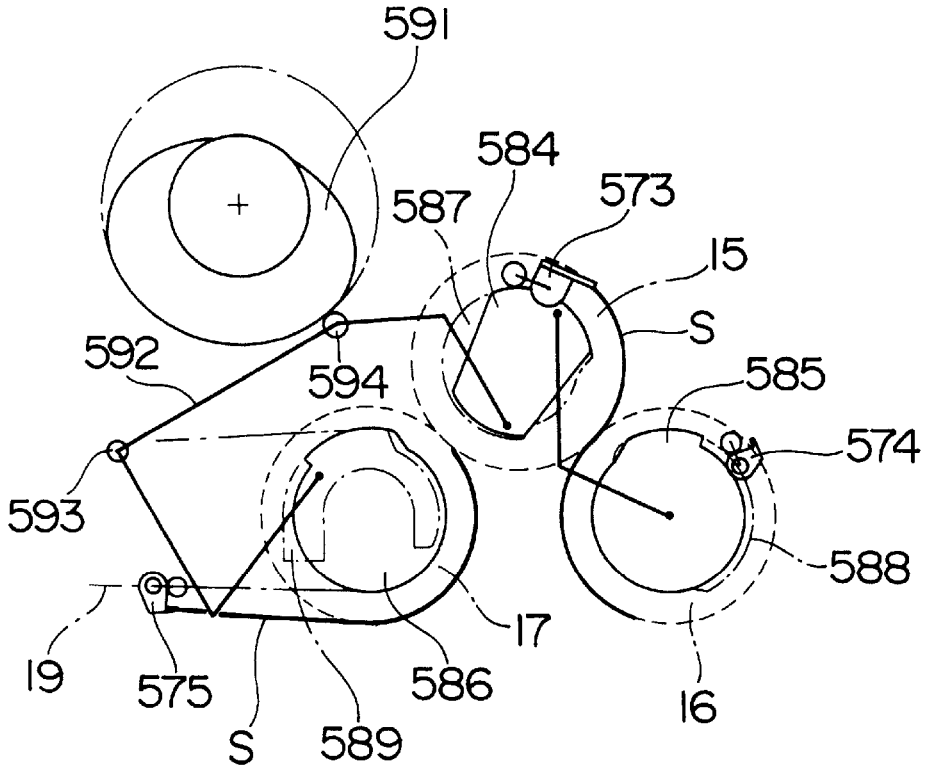
FIG. 29 is a still further explanatory view of the printing paper transfer operation.

With a still further rotation of the paper discharge cylinder 17, as shown in FIG. 29, the printing paper S is transported along the chains 19 to the position above the paper discharge station 28. In the position above the paper discharge station 28, the cam follower 583 of the gripper 575 contacts the contact element 599, whereby the gripper 575 is opened to release the printing paper S on the discharge station 28.

A printing paper transfer operation will be described next, which operation is carried out in monochromatic printing of the printing paper S with one of the yellow, magenta, cyan and black inks, or in two-color printing with one of the magenta and black inks and one of the yellow and cyan inks. In this case, as noted hereinbefore, the printing paper S must be fed from the paper feed cylinder 16 to the impression cylinder 15 for every rotation of the impression cylinder 15.

In this case, the solenoid 598 is operated to lock the stopper 597 to the position shown in FIG. 16, to place the distal end of the stopper 597 in engagement with the pin 595 projecting from the main link 592. Consequently, the main link 592 is maintained in the same state as where the cam follower 594 is in contact with the bulge of the cam 591.

Then, printing paper S is drawn from the paper storage 27 by action of the suction board 74 shown in FIG. 1. As in the case shown in FIG. 20, the forward end of printing paper S is transported toward the gripper 574 on the paper feed cylinder 16. At this time, the cam follower 582 of the gripper 574 is in contact with the bulge of the fixed cam 588 to maintain the gripper 574 open.

In this state, the paper feed cylinder 16 rotates to move the cam follower 582 of the gripper 574 past the bulge of the fixed cam 588. Then, as in the case shown in FIG. 21, the gripper 574 closes to grip the forward end of printing paper S.

With a further rotation of the paper feed cylinder 16, the gripper 574 on the paper feed cylinder 16 moves to a position opposed to the gripper 573 on the impression cylinder 15 as in the case shown in FIG. 22. Then, the cam follower 582 of the gripper 574 starts opening the gripper 574 by the action of fixed cam 588, while the cam follower 581 of the gripper 573 contacts the bulge of fixed cam 587 to start closing the gripper 573. As a result, the forward end of printing paper S is transferred from the gripper 574 to the gripper 573.

With rotation of the impression cylinder 15 in this state, a printing process is started for the printing paper S mounted on the impression cylinder 15. In this state, as in the case shown in FIG. 23, the cam follower 581 of the gripper 573 remains in contact with the bulge of the fixed cam 587, whereby the forward end of printing paper S remains gripped.

Figure 30:
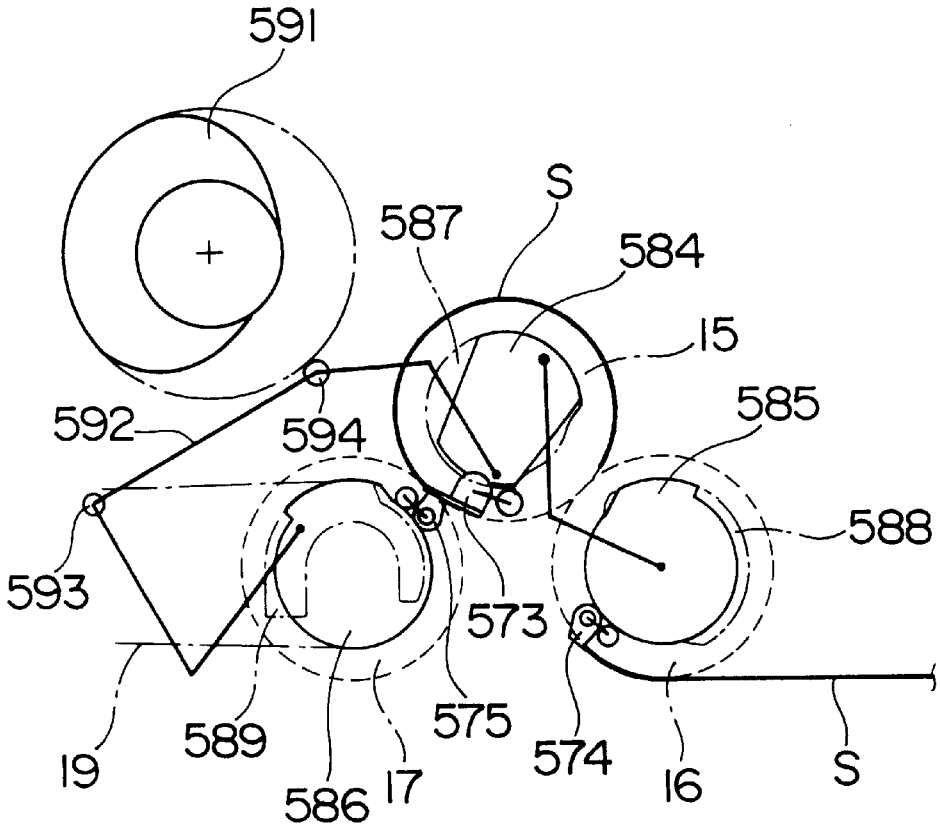
FIG. 30 is a still further explanatory view of the printing paper transfer operation.

FIG. 30 shows a state where, with a further rotation of the impression cylinder 15, the gripper 573 on the impression cylinder 15 has moved to a position opposed to one of the grippers 575 of the paper discharge cylinder 17. In the illustrated state, the stopper 597 maintains the main link 592 in the same state as where the cam follower 594 is in contact with the bulge of the cam 591. Thus, the movable cams 584, 585 and 586 and fixed cams 587, 588 and 589 are in the positional relationship shown in FIG. 19.

Consequently, as in the case shown in FIG. 27, the cam follower 581 of the gripper 573 on the impression cylinder 15 contacts the recess of the movable cam 584 to start opening the gripper 573. The cam follower 583 of the gripper 575 on the paper discharge cylinder 17 contacts the recess of the movable cam 586 to start closing the gripper 575. As a result, the printing paper S is transferred from the gripper 573 to the gripper 575.

In this state, a second sheet of printing paper S is transported as gripped by the gripper 574 on the paper feed cylinder 16.

Figure 31:
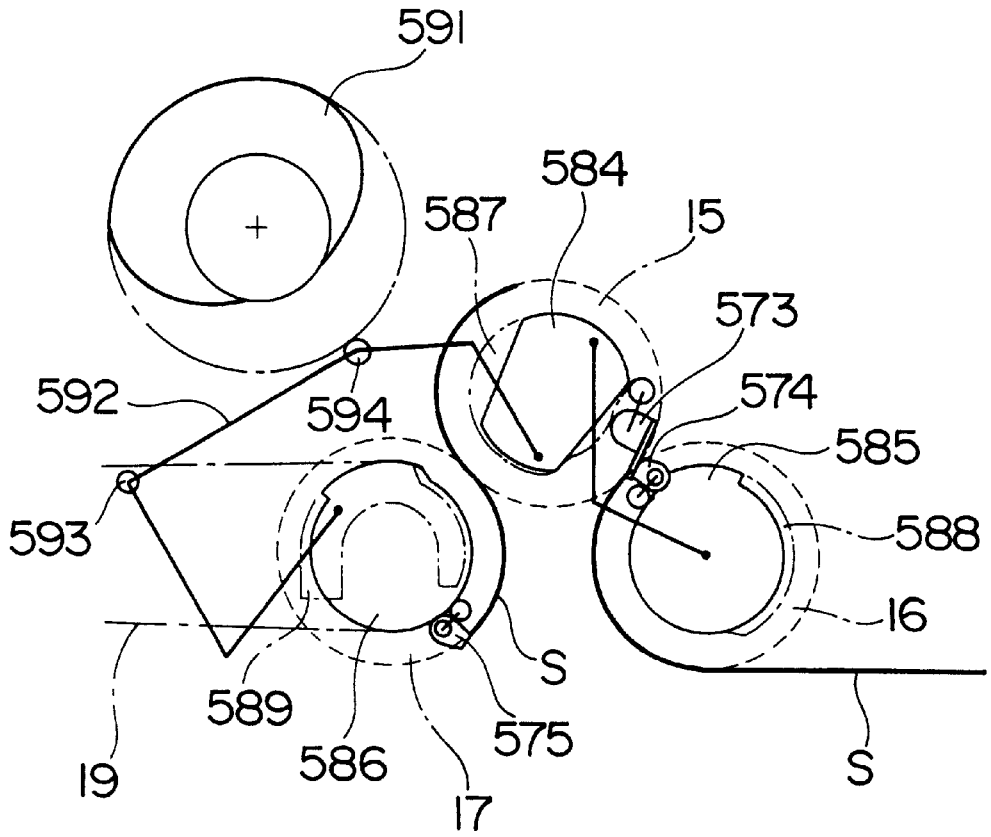
FIG. 31 is a still further explanatory view of the printing paper transfer operation.

FIG. 31 shows a state where, with a further rotation of the impression cylinder 15, the gripper 573 on the impression cylinder 15, after passing the printing paper S over to the gripper 575 on the paper discharge cylinder 17, has moved to the position opposed to the gripper 574 on the paper feed cylinder 16 holding the second sheet of printing paper S. In the state also, the stopper 597 maintains the main link 592 in the same state as where the cam follower 594 is in contact with the bulge of the cam 591. Thus, the movable cams 584, 585 and 586 and fixed cams 587, 588 and 589 are in the positional relationship shown in FIG. 19.

Consequently, as in the state shown in FIG. 22, the cam follower 582 of the gripper 574 on the paper feed cylinder 16 starts opening the gripper 574 by the action of fixed cam 588, while the cam follower 581 of the gripper 573 contacts the bulge of fixed cam 587 to start closing the gripper 573. As a result, the forward end of printing paper S is transferred from the gripper 574 to the gripper 573.

Figure 32:
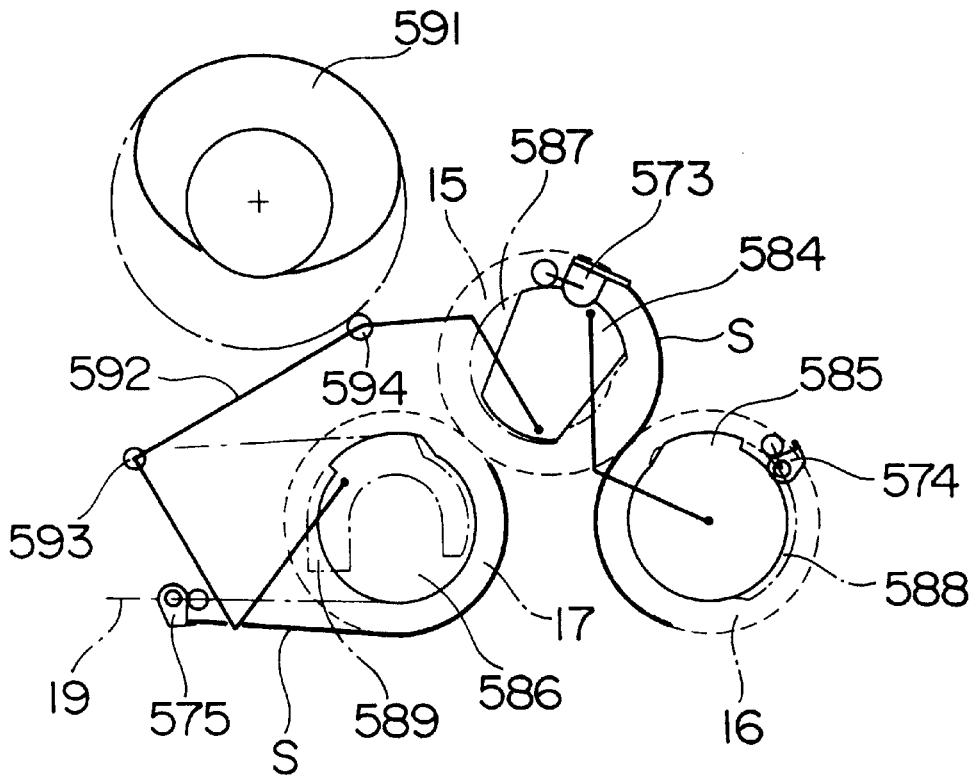
FIG. 32 is a still further explanatory view of the printing paper transfer operation.

With a further rotation of the impression cylinder 15, paper feed cylinder 16 and paper discharge cylinder 17, as shown in FIG. 32, a printing operation is started for the second sheet of printing paper S mounted on the impression cylinder 15. The printing paper S held by the paper discharge cylinder 17 is transported along the chains 19 to the position above the paper discharge station 28, and allowed to fall on the discharge station 28.

As described above, the gripper control mechanism is operable for controlling the stopper 597 to release the main link 592 and allow the pivotal movement of the main link 592. Then, the printing paper S may be transferred among the impression cylinder 15, paper feed cylinder 16 and paper discharge cylinder 17 for every two rotations of the impression cylinder 15. When the stopper 579 is actuated to prohibit the pivotal movement of the main link 592, the printing paper S may be transferred among the impression cylinder 15, paper feed cylinder 16 and paper discharge cylinder 17 for every single rotation of the impression cylinder 15. Thus, the apparatus is capable of selectively executing four-color printing and monochromatic printing or two-color printing.

In the above printing apparatus, the impression cylinder 15 has half the diameter of the first and second plate cylinders 11 and 12 and the first and second blanket cylinders 13 and 14. The diameter of the impression cylinder may be n/2, where n is an odd number, of the diameter of the first and second plate cylinders 11 and 12 and the first and second blanket cylinders 13 and 14.

Figure 33:
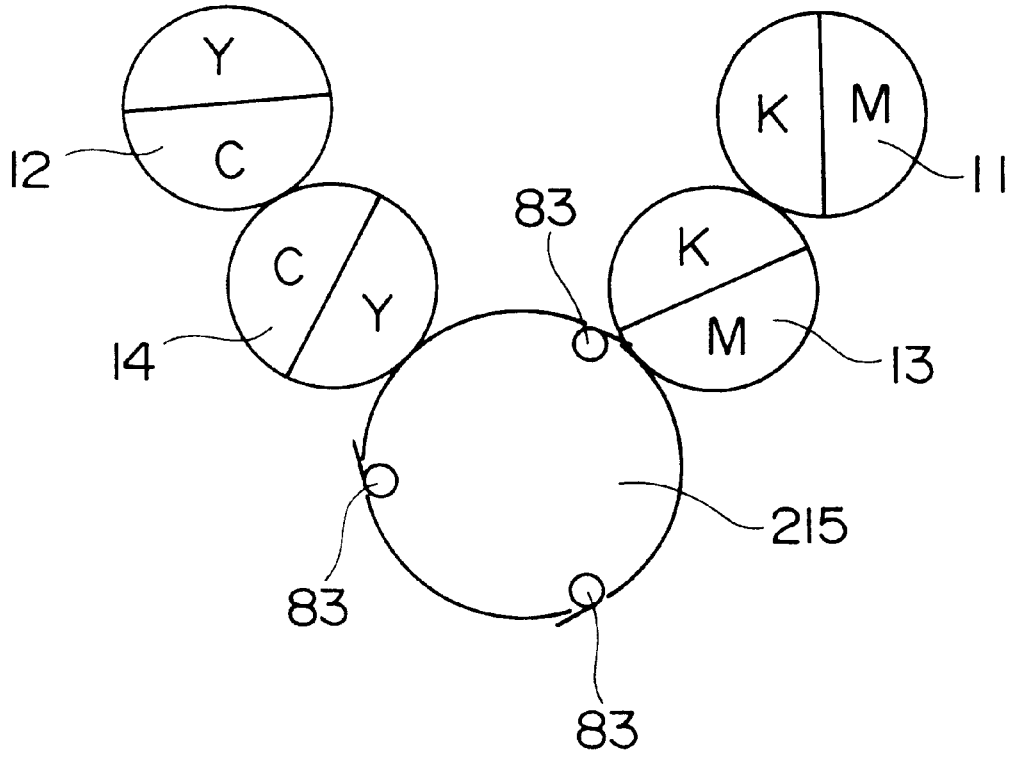
FIG. 33 is an explanatory view of a printing apparatus in a different embodiment.

FIG. 33 is an explanatory view illustrating the construction of a printing apparatus in such an embodiment. FIG. 33 shows, among the components of the entire printing apparatus, an impression cylinder 215 along with the first and second plate cylinders 11 and 12 and the first and second blanket cylinders 13 and 14 as in the apparatus shown in FIG. 1. The other aspects of the construction are the same as in the printing apparatus described hereinbefore.

In this printing apparatus, the impression cylinder 215 has a diameter which is 3/2 of the diameter of the first and second plate cylinders 11 and 12 and the first and second blanket cylinders 13 and 14. In this printing apparatus, therefore, the first and second plate cylinders 11 and 12 and the first and second blanket cylinders 13 and 14 make three rotations for every two rotations of the impression cylinder 215. The impression cylinder 215 has three grippers 83 arranged at equal intervals peripherally thereof for holding three sheets of printing paper S.

When this printing apparatus is used to perform four-color printing with the yellow, magenta, cyan and black inks, three sheets of printing paper S wrapped around the impression cylinder 215 are printed in the four colors of yellow, magenta, cyan and black with two rotations of the impression cylinder 215. Thus, for every two rotations of the impression cylinder 215, three new sheets of printing paper S are fed from the paper feed cylinder 16 to perform the four-color printing continuously.

This printing apparatus may also be used for monochromatic printing of the printing paper with one of the yellow, magenta, cyan and black inks, or two-color printing with one of the magenta and black inks and one of the yellow and cyan inks. In this case, three new sheets of printing paper S may be fed from the paper feed cylinder 16 for every rotation of the impression cylinder 215.

The foregoing embodiments have been described where the present invention is applied to the printing apparatus invariably employing the first and second plate cylinders 11 and 12 and the first and second blanket cylinders 13 and 14 to be capable of four-color printing. The invention is applicable also to a printing apparatus employing a single plate cylinder and a single blanket cylinder for printing in two colors or less.

The present invention may be embodied in other specific forms without departing from the spirit or essential attributes thereof and, accordingly, reference should be made to the appended claims, rather than to the foregoing specification, as indicating the scope of the invention.

The present application claims priority benefit under 35 U.S.C. Section 119 of Japanese Patent Application No.9-293603 filed in the Japanese Patent Office on Oct. 9, 1997, the entire disclosure of which is incorporated herein by reference.

What is claimed is:

1. A printing apparatus comprising:

a first plate cylinder that supports one plate mounted peripherally thereof;

a second plate cylinder that supports one plate mounted peripherally thereof;

an image recorder that forms two image areas on each of said plate supported by said first plate cylinder and said plate supported by said second plate cylinder by recording images on said plate supported by said first plate cylinder and said plate supported by said second plate cylinder;

a first and a second ink feeder that can feed different color inks to said two image areas on said plate supported by said first plate cylinder;

a third and a fourth ink feeder that can feed different color inks to the two image areas on said plate supported by said second plate cylinder;

a first blanket cylinder equal in diameter to and contactable with said first plate cylinder;

a second blanket cylinder equal in diameter to and contactable with said second plate cylinder;

an impression cylinder having a diameter n/2 of the diameter of said first and second plate cylinders and said first and second blanket cylinders, wherein n is an odd number and said impression cylinder is contactable with said first and second blanket cylinders;

n printing paper holding means having a gripper for holding an end of printing paper to maintain n sheets of said printing paper peripherally of said impression cylinder;

contact mechanisms that move said first and second blanket cylinders independently of each other into and out of contact with said impression cylinder;

a printing paper feeder that feeds said printing paper to said impression cylinder;

a printing paper discharger that discharges said printing paper from said impression cylinder after a required printing process; and a printing paper holding means control mechanism that controls said printing paper holding means to selectively switch between a first operation mode having a first opening and closing operation once for every rotation of said impression cylinder and a second operation mode having a second opening and closing operation once for every two rotations of said impression cylinder, wherein:

when the printing apparatus is in said second operation mode, said contact mechanisms place both of said first blanket cylinder and said second blanket cylinder in contact with said impression cylinder;

said image recorder forms two image areas having different images on the plate supported by said first plate cylinder and two image areas having different images on the plate supported by said second plate cylinder; and said first ink feeder and said second ink feeder feed different color inks, respectively, to the two image areas formed on the plate supported by said first plate cylinder, while said third ink feeder and said fourth ink feeder feed different color inks, respectively, to the two image areas formed on the plate supported by said second plate cylinder;

wherein a four color printing operation is performed using the four color inks fed from said first ink feeder, said second ink feeder, said third ink feeder and said fourth ink feeder.

2. The printing apparatus according to claim 1, wherein:

when the printing apparatus is in said first operation mode, one of said contact mechanisms places one of said first blanket cylinder and said second blanket cylinder in contact with said impression cylinder;

said image recorder forms two image areas having the same image on the plate supported by the plate cylinder associated with said one of said first blanket cylinder and said second blanket cylinder placed in contact with said impression cylinder; and one of said ink feeders feeds the same color ink to the two image areas having the same image;

wherein a monochromatic printing operation is performed.

3. The printing apparatus according to claim 1, wherein:

when the printing apparatus is in said first operation mode, said contact mechanisms place said first blanket cylinder and said second blanket cylinder in contact with said impression cylinder;

said image recorder forms two image areas having the same image on the plate supported by said first plate cylinder and two image areas having the same image on the plate supported by said second plate cylinder; and one of said first ink feeder and said second ink feeder feeds the same color ink to the two image areas formed on the plate supported by said first plate cylinder, while one of said third ink feeder and said fourth ink feeder feeds the same color ink to the two image areas formed on the plate supported by said second plate cylinder;

wherein a two-color printing operation is performed using one color ink fed from one of said first ink feeder and said second ink feeder, and one color ink fed from one of said third ink feeder and said fourth ink feeder.

4. A printing apparatus comprising:

a first plate cylinder that supports one plate mounted peripherally thereof;

a second plate cylinder that supports one plate mounted peripherally thereof;

an image recorder that forms two image areas on each of said plate supported by said first plate cylinder and said plate supported by said second plate cylinder by recording images on said plate supported by said first plate cylinder and said plate supported by said second plate cylinder;

first and a second ink feeders that can feed different color inks to the two image areas on said plate supported by said first plate cylinder;

third and a fourth ink feeders that can feed different color inks to the two image areas on said plate supported by said second plate cylinder;

a first blanket cylinder equal in diameter to and contactable with said first plate cylinder;

a second blanket cylinder equal in diameter to and contactable with said second plate cylinder;

an impression cylinder having a diameter n/2 of the diameter of said first and second plate cylinders and said first and second blanket cylinders, wherein n is an odd number and said impression cylinder is contactable with said first and second blanket cylinders;

n printing paper holding means having a gripper for holding an end of printing paper to maintain n sheets of said printing paper peripherally of said impression cylinder;

contact mechanisms that move said first and second blanket cylinders independently of each other into and out of contact with said impression cylinder;

a printing paper feeder that feeds said printing paper to said impression cylinder;

a printing paper discharger that discharges said printing paper from said impression cylinder after a required printing process; and a printing pager holding means control mechanism that controls said printing paper holding means to selectively switch between a first operation mode having a first opening and closing operation once for every rotation of said impression cylinder and a second operation mode having a second opening and closing operation once for every two rotations of said impression cylinder;

wherein said printing gaper holding means control mechanism comprises:

a fixed cam that is disposed laterally of said impression cylinder and contactable with a cam follower attached to said gripper of said printing paper holding means to open said gripper, said fixed cam opening and closing said printing paper holding means once for every rotation of said impression cylinder;

a movable cam that is disposed coaxially with said fixed cam and movable between an open/close prohibiting position that prohibits said fixed cam from opening and closing said printing paper holding means from opening and closing, and an olen/close permitting position that permits said axed cam to open and close said printing paper holding means, a movable cam drive mechanism that reciprocates said movable cam between said open/close prohibiting position and said open/close permitting position by the rotation of said impression cylinder; and a movable cam stop mechanism that stops said movable cam in said open/close permitting position.

5. The printing apparatus according to claim 4, wherein said movable cam drive mechanism comprises:

a cam that can be synchronized to rotate with said blanket cylinders; and a link mechanism coupled to said movable cam, said link niechanism including a cam follower contactable with said cam that can be synchronized to rotate with said blanket cylinders so as to be pivotable with the rotation of said blanket cylinders to reciprocate said movable cam between said open/close prohibiting position and said open/close permitting position.

6. A printing apparatus according to claim 5, wherein said movable cam stop mechanism comprises a stopper that prohibits pivotal movement of said link mechanism.

7. A printing apparatus comprising:

a first plate cylinder that supports two plates mounted peripherally thereof;

a second plate cylinder that supports two plates mounted peripherally thereof;

an image recorder that forms one image area on each of said two plates supported by said first plate cylinder and said two plates supported by said second plate cylinder by recording images on said plates;

a first and a second ink feeder that can feed different color inks, respectively, to the image areas on said two plates supported by said first plate cylinder;

a third and a fourth ink feeder that can feed different color inks, respectively, to the image areas on said two plates supported by said second plate cylinder;

a first blanket cylinder equal in diameter to and contactable with said first plate cylinder;

a second blanket cylinder equal in diameter to and contactable with said second plate cylinder;

an impression cylinder having a diameter n/2 of the diameter of said first and second plate cylinders and said first and second blanket cylinders, wherein n is an odd number and said impression cylinder is contactable with said first and second blanket cylinders;

n printing paper holding means having a gripper for holding an end of printing paper to maintain n sheets of said printing paper peripherally of said impression cylinder;

contact mechanisms that move said first and second blanket cylinders independently of each other into and out of contact with said impression cylinder;

a printing paper feeder that feeds said printing paper to said impression cylinder;

a printing paper discharger that discharges said printing paper from said impression cylinder after a required printing process; and a printing paper holding means control mechanism that controls said printing paper holding means to selectively switch between a first operation mode having a first opening and closing operation once for every rotation of said impression cylinder and a second operation mode having a second opening and closing operation once for every two rotations of said impression cylinder, wherein:

when the printing apparatus is in said second operation mode, said contact mechanisms place both of said first blanket cylinder and said second blanket cylinder in contact with said impression cylinder;

said image recorder forms one image area having a different image on each of the two plates supported by said first plate cylinder and one image area having a different image on each of the two plates supported by said second plate cylinder; and said first ink feeder and said second ink feeder feed different color inks, respectively, to the image areas formed on the two plates supported by said first plate cylinder, while said third ink feeder and said fourth ink feeder feed different color inks, respectively, to the image areas formed on the two plates supported by said second plate cylinder;

whereby a four-color printing operation is performed using the four color inks fed from said first ink feeder, said second ink feeder, said third ink feeder and said fourth ink feeder.

8. The printing apparatus according to claim 7, wherein:

when the printing apparatus is in said first operation mode, said contact mechanisms places both of said first blanket cylinder and said second blanket cylinder in contact with said impression cylinder;

said image recorder forms one image area having the same image on each of the two plates supported by said first plate cylinder and one image area having the same image on each the two plates supported by said second plate cylinder; and one of said first ink feeder and said second ink feeder feeds the same color ink to each of the image areas formed on the two plates supported by said first plate cylinder, while one of said third ink feeder and said fourth ink feeder feeds the same color ink to each of the image areas formed on the two plates supported by said second plate cylinder;

whereby a two-color printing operation is performed using one color ink fed from one of said first ink feeder and said second ink feeder, and one color ink fed from one of said third ink feeder and said fourth ink feeder.

9. The printing apparatus according to claim 7, wherein:

when the printing apparatus is in said first operation mode, one of said contact mechanisms places one of said first blanket cylinder and said second blanket cylinder in contact with said impression cylinder;

said image recorder forms one image area having the same image on each, of the two plates supported by the plate cylinder associated with said one of said first blanket cylinder and said second blanket cylinder placed in contact with said impression cylinder; and one of said ink feeders feeds the same color ink to the two image areas having the same image;

whereby a monochromatic printing operation is performed.

10. A printing apparatus comprising;

a first plate cylinder that supports two plates mounted peripherally thereof, a second plate cylinder that supports two plates mounted peripherally thereof;

an image recorder that forms one image area on each of said two plates supported by said first plate cylinder and said two plates supported by said second plate cylinder by recording images on said plates;

a first and a second ink feeders that can feed different color inks, respectively, to the image areas on said two plates supported by said first plate cylinder;

a third and a fourth ink feeders that can feed different color inks, respectively, to the image areas on said two plates supported by said second plate cylinder;

a first blanket cylinder equal in diameter to and contactable with said first plate cylinder;

a second blanket cylinder equal in diameter to and contactable with said second plate cylinder;

an impression cylinder having a diameter n/2 of the diameter of said first and second plate cylinders and said first and second blanket cylinders, wherein n is an odd number and said impression cylinder is contactable with said first and second blanket cylinders;

n printing paper holding means having a gripper for holding an end of printing paper to maintain n sheets of said printing paper peripherally of said impression cylinder;

contact mechanisms that move said first and second blanket cylinders independently of each other into and out of contact with said impression cylinder;

a printing paper feeder that feeds said printing paper to said impression cylinder;

a printing paper discharger that discharges said printing paper from said impression cylinder after a required printing process; and a printing paper holding means control mechanism that controls said printing pager holding means to selectively switch between a first operation mode having a first opening and closing operation once for every rotation of said impression cylinder and a second operation mode having a second opening and closing operation once for every two rotations of said impression cylinder;

wherein said printing paper holding means control mechanism comprises:

a fixed cam that is disposed laterally of said impression cylinder and contactable with a cam follower attached to said gripper of said printing paper holding means to open said gripper, said fixed cam opening and closing said printing gaper holding means once for every rotation of said impression cylinder;

a movable cam that is disposed coaxially with said fixed cam and movable between an open/close prohibiting position that prohibits said fixed cam from opening and closing said printing paper holding means from opening and closing, and an open/close permitting position that permits said fixed cam to open and close said printing paper holding means;

a movable cam drive mechanism that reciprocates said movable cam between said open/close prohibiting position and said open/close permitting position by the rotation of said impression cylinder; and a movable cam stop mechanism that stops said movable cam in said open/close permitting position.

11. The printing apparatus according to claim 10, wherein said movable cam drive mechanism comprises:

a cam that can be synchronized to rotate with said blanket cylinders; and a link mechanism coupled to said movable cam, said link mechanism including a cam follower contactable with said cam that can be synchronized to rotate with said blanket cylinders so as to be pivotable with the rotation of said blanket cylinders to reciprocate said movable cam between said open/close prohibiting position and said open/close permitting position.

12. The printing apparatus according to claim 11, wherein said movable cam stop mechanism comprises a stopper that prohibits pivotal movement of said link mechanism.

* * * * *